US009568000B2

(12) United States Patent
Yamada et al.

(10) Patent No.: US 9,568,000 B2
(45) Date of Patent: Feb. 14, 2017

(54) COMPRESSOR

(75) Inventors: Masahiro Yamada, Sakai (JP); Yasuhiro Murakami, Sakai (JP); Nobuo Takahashi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 299 days.

(21) Appl. No.: 13/522,922

(22) PCT Filed: Jan. 19, 2011

(86) PCT No.: PCT/JP2011/050876

§ 371 (c)(1),
(2), (4) Date: Jul. 18, 2012

(87) PCT Pub. No.: WO2011/090075

PCT Pub. Date: Jul. 28, 2011

(65) Prior Publication Data

US 2012/0294733 A1 Nov. 22, 2012

(30) Foreign Application Priority Data

Jan. 20, 2010 (JP) ..... 2010-010222

(51) Int. Cl.
*F04B 49/06* (2006.01)
*F04B 49/02* (2006.01)
(Continued)

(52) U.S. Cl.
CPC ..... *F04C 18/0215* (2013.01); *F04B 49/02* (2013.01); *F04B 49/06* (2013.01); *F04C 23/008* (2013.01);
(Continued)

(58) Field of Classification Search
CPC ..... F04C 2270/19; F04C 28/00; F04C 28/06; F04C 28/28; F04C 29/02; F04C 29/021–29/028; F04C 2270/195; F04B 35/04;F04B 39/0207; F04B 49/00; F04B 49/02; F04B 49/06; F04B 49/065; F04B 2201/0402; F04B 2203/021
(Continued)

(56) References Cited

U.S. PATENT DOCUMENTS 3,877,837 A * 4/1975 Parker et al. ..... 417/25
4,564,339 A * 1/1986 Nakamura et al. ..... 417/366
(Continued)

FOREIGN PATENT DOCUMENTS

CN 101372961 A * 2/2009
JP 7-35080 A 2/1995
(Continued)

OTHER PUBLICATIONS

International Search Report of corresponding PCT Application No. PCT/JP2011/050876.
(Continued)

*Primary Examiner* — Alexander Comley
(74) *Attorney, Agent, or Firm* — Global IP Counselors

(57) ABSTRACT

A compressor includes a casing, a compression mechanism, a drive shaft, a main frame, a motor, a flow path forming member, and a temperature measuring mechanism. The casing stores lubricating oil in its bottom portion. The main frame has the compression mechanism placed on it and supports the drive shaft in such a way that the drive shaft may freely rotate. The flow path forming member forms an oil flow path at a space adjacent an inner peripheral surface of the casing. The oil flow path carries a flow of lubricating oil, which lubricates sliding portions including the compression mechanism and the drive shaft. The temperature measuring mechanism is disposed outside the casing. The temperature measuring mechanism measures the temperature of a section of an outer peripheral surface of the casing adjacent the oil flow path.

8 Claims, 19 Drawing Sheets

(51) Int. Cl.

| | |
|---|---|
| ***F04C 23/00*** | (2006.01) |
| ***F04C 28/28*** | (2006.01) |
| ***F04C 29/02*** | (2006.01) |
| ***F04C 18/02*** | (2006.01) |
| *F04C 29/12* | (2006.01) |

(52) U.S. Cl.
CPC ..... *F04C 28/28* (2013.01); *F04C 29/026* (2013.01); *F04C 29/028* (2013.01); *F04B 2203/021* (2013.01); *F04C 29/12* (2013.01); *F04C 2240/81* (2013.01); *F04C 2270/19* (2013.01); *F04C 2270/70* (2013.01); *F04C 2270/86* (2013.01)

(58) Field of Classification Search
USPC ..... 417/63, 410.5, 281, 32, 292, 902, 228; 418/2, 84, 55.6
See application file for complete search history.

(56) References Cited

U.S. PATENT DOCUMENTS

| | | | | | |
|---|---|---|---|---|---|
| 4,623,306 | A | * | 11/1986 | Nakamura et al. | 418/55.6 |
| 4,666,381 | A | * | 5/1987 | Butterworth | 418/55.6 |
| 4,889,471 | A | * | 12/1989 | Izunaga et al. | 417/32 |
| 4,936,747 | A | * | 6/1990 | Mitsuhashi et al. | 417/32 |
| 4,997,349 | A | * | 3/1991 | Richardson, Jr. | 418/55.5 |
| 5,533,875 | A | * | 7/1996 | Crum et al. | 417/368 |
| 5,765,994 | A | * | 6/1998 | Barbier | 417/12 |
| 6,135,738 | A | * | 10/2000 | Kajiwara et al. | 418/55.4 |
| 6,276,901 | B1 | * | 8/2001 | Farr et al. | 417/13 |
| 6,280,146 | B1 | * | 8/2001 | Bush et al. | 417/13 |
| 6,485,268 | B1 | * | 11/2002 | Hugenroth et al. | 417/228 |
| 6,648,607 | B2 | * | 11/2003 | Milliff et al. | 417/228 |
| 6,896,498 | B1 | * | 5/2005 | Patel | 418/55.5 |
| 7,021,912 | B2 | * | 4/2006 | Tsuchiya et al. | 418/94 |
| 7,568,894 | B2 | * | 8/2009 | Uratani | 417/63 |
| 7,585,160 | B2 | * | 9/2009 | Hirooka et al. | 417/410.5 |
| 8,105,054 | B2 | * | 1/2012 | Oo et al. | 417/410.5 |
| 2005/0100449 | A1 | * | 5/2005 | Hahn et al. | 417/279 |
| 2005/0254977 | A1 | * | 11/2005 | Aya et al. | 417/437 |
| 2012/0294733 | A1 | * | 11/2012 | Yamada et al. | 417/63 |

FOREIGN PATENT DOCUMENTS

| | | | | |
|---|---|---|---|---|
| JP | 07035080 | A | * | 2/1995 |
| JP | 2503699 | B2 | | 4/1996 |
| JP | 10-9685 | A | | 1/1998 |
| JP | 2005-344612 | A | | 12/2005 |
| JP | 2009-197621 | A | | 9/2009 |
| JP | 2009-216026 | A | | 9/2009 |
| JP | 4513238 | B2 | | 5/2010 |

OTHER PUBLICATIONS

International Preliminary Report of corresponding PCT Application No. PCT/JP2011/050876.

* cited by examiner

COMPRESSOR

CROSS-REFERENCE TO RELATED APPLICATIONS

This U.S. National stage application claims priority under 35 U.S.C. §119(a) to Japanese Patent Application No. 2010-010222, filed in Japan on Jan. 20, 2010, the entire contents of which are hereby incorporated herein by reference.

TECHNICAL FIELD

The present invention relates to a compressor. In particular, the present invention relates to a compressor that has a mechanism that measures the temperature of lubricating oil inside a casing.

BACKGROUND ART

Conventionally, in order to ensure the reliability of a compressor that configures the refrigeration cycle of an air conditioning apparatus or the like, a compressor protection device that prevents an abnormal rise in the temperature inside the compressor has been used. The compressor protection device is configured from a temperature detecting mechanism and an operation shutdown mechanism, the example. The temperature detecting mechanism is attached to the compressor body and measure the temperature inside the compressor. The operation shutdown mechanism performs an action to protect the compressor by shutting down the operation of the compressor in a case where the temperature that the temperature detecting mechanism has detected has exceeded a predetermined temperature.

It has been conventionally common for the temperature detecting mechanism to measure the surface temperature of a casing of the compressor or the surface temperature of a discharge tube that sends compressed refrigerant to a refrigerant circuit outside the compressor. For example, in the compressor described in Japanese Unexamined Publication No. 2009-197621, there is disposed a temperature sensor holding mechanism for closely fixing a temperature sensor to the surface of the top portion of the casing of the compressor. With this temperature sensor holding mechanism, the temperature sensor can be reliably installed in a predetermined position on the surface of the top portion of the casing of the compressor. Additionally, an action to protect the compressor is performed on the basis of the casing surface temperature that has been measured by the temperature sensor. Further, in the compressor described in Japanese Patent No. 2,503,699, the temperature of the compressed refrigerant inside the discharge tube is measured by a temperature sensor that is fixed to the surface of the discharge tube of the compressor. Additionally, an action to protect the compressor is performed on the basis of the temperature of the compressed refrigerant that has been measured by the temperature sensor.

SUMMARY

Technical Problem

However, even if an action to protect the compressor is performed on the basis of the surface temperature of the casing of the compressor or the discharge tube, there are cases where the reliability of the compressor is not sufficiently ensured.

For example, at the time of a pump-down operation of the compressor that recovers, in a condenser or a liquid receiver, the refrigerant circulating in the refrigeration cycle in order to repair or relocate the air conditioning apparatus or the like, the refrigerant does not flow inside the compressor, so the temperature of the discharge tube does not rise. However, even at the time of a pump-down operation, the temperature of lubricating oil circulating inside the compressor rises as a result of bearing portions and so forth inside the compressor sliding, so the temperature inside the compressor also rises. For that reason, even if the temperature of the discharge tube of the compressor is measured, the rise in the temperature inside the compressor cannot be appropriately detected.

Further, in the case of measuring the temperature inside the compressor on the basis of the casing surface temperature, even if the casing surface temperature in the neighborhood of the space inside the compressor where the lubricating oil hardly flows is measured, the rise in the temperature inside the compressor cannot be appropriately detected.

Therefore, it is an object of the present invention to improve the reliability of a compressor by appropriately measuring the temperature inside the compressor.

Solution to Problem

A compressor pertaining to a first aspect of the present invention is equipped with a casing, a compression mechanism, a drive shaft, a main frame, a motor, a flow path forming member, and a temperature measuring mechanism. The casing stores lubricating oil in its bottom portion. The compression mechanism is disposed inside the casing and compresses refrigerant. The drive shaft is disposed inside the casing and drives the compression mechanism. The main frame has the compression mechanism placed on it and is air-tightly joined to, across the entire periphery of, an inner peripheral surface of the casing. The main frame supports the drive shaft in such a way that the drive shaft may freely rotate. The motor is disposed under the main frame and drives the drive shaft. The flow path forming member is disposed inside the casing and forms an oil flow path. The oil flow path is a space located in the neighborhood of the inner peripheral surface of the casing and through which lubricating oil that lubricates sliding portions including the compression mechanism and the drive shaft flows. The temperature measuring mechanism is disposed outside the casing. The temperature measuring mechanism measures the temperature of a section of an outer peripheral surface of the casing positioned in the neighborhood of the oil flow path.

In the compressor pertaining to the first aspect, the high-temperature lubricating oil that has lubricated the sliding portions inside the compressor flows through the oil flow path that is a space in the neighborhood of the inner peripheral surface of the casing. In a case where the compressor is a scroll compressor, the sliding portions are, for example, a sliding portion between a fixed scroll and a movable scroll and a sliding portion between a drive shaft that drives the movable scroll and a bearing. In a case where the flow path forming member is a tubular member, the oil flow path is a space inside the tube, and in a case where the flow path forming member is a plate-like member, the oil flow path is a space sandwiched between the flow path forming member and the inner peripheral surface of the casing.

Further, in the compressor pertaining to the first aspect, the high-temperature lubricating oil that has lubricated the sliding portions inside the compressor comes into contact with the inner peripheral surface of the casing, whereby the heat of the lubricating oil is transmitted to the casing. Further, the high-temperature lubricating oil comes into contact with the flow path forming member, whereby the heat of the lubricating oil is transmitted to the casing via the flow path forming member. As a result, the temperature of the outer peripheral surface of the casing rises. Consequently, by using the temperature measuring mechanism such as a temperature sensor to measure the temperature of the outer peripheral surface of the casing, the temperature of the high-temperature lubricating oil that has lubricated the sliding portions inside the compressor can be measured. The temperature of the high-temperature lubricating oil can be used as an indicator of the temperature inside the compressor.

In the compressor pertaining to the first aspect, the temperature inside the compressor can be appropriately measured by the temperature measuring mechanism. Further, in the compressor pertaining to the first aspect, in a case where the temperature that has been measured by the temperature measuring mechanism has reached a predetermined value, it is judged that the temperature inside the compressor has risen abnormally and the operation of the compressor is stopped, whereby the reliability of the compressor can be improved.

A compressor pertaining to a second aspect of the present invention is the compressor pertaining to the first aspect, wherein the oil flow path has a space contiguous to the inner peripheral surface of the casing, and the flow path forming member has a section contiguous to the inner peripheral surface of the casing. The temperature measuring mechanism measures at least one of the temperature of a temperature measuring region or the temperature in the neighborhood of the temperature measuring region. The temperature measuring region is a section of the outer peripheral surface of the casing corresponding to the back side of a section of the inner peripheral surface of the casing contiguous to the oil flow path and the flow path forming member.

In the compressor pertaining to the second aspect, the high-temperature lubricating oil that has lubricated the sliding portions inside the compressor flows through the oil flow path having the space contiguous to the inner peripheral surface of the casing. Because of this, the high-temperature lubricating oil that has lubricated the sliding portions inside the compressor comes into contact with the inner peripheral surface of the casing, whereby the heat of the lubricating oil is transmitted to the casing. Further, the flow path forming member has the section contiguous to the inner peripheral surface of the casing. Because of this, the high-temperature lubricating oil that has lubricated the sliding portions inside the compressor comes into contact with the flow path forming member, whereby the heat of the lubricating oil is transmitted to the casing via the flow path forming member, Consequently, the temperature measuring region is a section to which the heat of the lubricating oil is easily transmitted, on the temperature measuring mechanism can more appropriately measure the temperature of the lubricating oil by measuring the temperature of the temperature measuring region or the region in the neighborhood thereof.

A compressor pertaining to a third aspect of the present invention is the compressor pertaining to the second aspect, wherein the temperature measuring mechanism measures the temperature of the temperature measuring region.

In the compressor pertaining to the third aspect, the temperature measuring mechanism measures the temperature of the temperature measuring region. The temperature measuring region is a section to which the heat of the lubricating oil is particularly easily transmitted, so the temperature measuring mechanism can more appropriately measure the temperature of the lubricating oil by measuring the temperature of the temperature measuring region.

A compressor pertaining to a fourth aspect of the present invention is the compressor pertaining to the third aspect, wherein the oil flow path has a narrow portion that is a space having a substantially flat-shaped flow path cross section. The narrow portion has a shape in which a long axis direction of the flow path cross section is along a circumferential direction of the casing. Further, the narrow portion has a flow path cross-sectional area that is smaller than the flow path cross-sectional area of the oil flow path excluding the narrow portion. The temperature measuring mechanism measures the temperature of the temperature measuring region in the neighborhood of the narrow portion.

In the compressor pertaining to the fourth aspect, the oil flow path has the narrow portion whose flow path cross-sectional area is small. In the narrow portion, the flow rate of the lubricating oil is reduced, so the flow speed of the lubricating oil flowing through the oil flow path is reduced in the narrow portion. Consequently, the amount of time in which the lubricating oil flowing through the oil flow path is in contact with the flow path forming member and the inner peripheral surface of the casing at the narrow portion is longer than the amount of time in which the lubricating oil flowing through the oil flow path is in contact with the flow path forming member and the inner peripheral surface of the casing at other sections of the oil flow path excluding the narrow portion.

Further, in the compressor pertaining to the fourth aspect, the flow path cross section of the narrow portion has a substantially flat shape in which the long axis direction is along the circumferential direction of the casing. Consequently, in a case where the flow path cross section of the narrow portion is contiguous to the inner peripheral surface of the casing, the region of the inner peripheral surface of the casing contiguous to the narrow portion is large, so the heat of the lubricating oil flowing through the narrow portion is easily transmitted to the inner peripheral surface of the casing. That is, the temperature measuring region positioned in the neighborhood of the narrow portion is a section to which the heat of the lubricating oil is particularly easily transmitted, on the temperature measuring mechanism can more appropriately measure the temperature of the lubricating oil by measuring the temperature of the temperature measuring region positioned in the neighborhood of the narrow portion.

A compressor pertaining to a fifth aspect of the present invention is the compressor pertaining to any one of the first aspect to the fourth aspect, wherein the flow path forming member is an oil return plate. The oil return plate is a plate member disposed under the main frame and above the motor. The oil flow path is a space between the inner peripheral surface of the casing and the oil return plate.

A compressor pertaining to a sixth aspect of the present invention is the compressor pertaining to any one of the first aspect to the fourth aspect, wherein the flow path forming member is an oil return plate. The oil return plate is a plate member disposed under the motor. The oil flow path is a space between the inner peripheral surface of the casing and the oil return plate.

A compressor pertaining to a seventh aspect of the present invention is the compressor pertaining to any one of the first aspect to the fourth aspect, wherein the main frame has an oil return passageway through which lubricating oil that has lubricated the sliding portions flows. The flow path forming member has a flow path forming surface that is part of a side surface of the main frame. The flow path forming surface has a surface that is spaced apart from and opposes the inner peripheral surface of the casing and to which the oil return passageway opens. The oil flow path is a space between the inner peripheral surface of the casing and the flow path forming surface.

A compressor pertaining to an eighth aspect of the present invention is the compressor pertaining to any one of the first aspect to the fourth aspect, wherein the flow path forming member has a flow path forming surface that is part of the outer peripheral surface of the motor. The oil flow path is a space between the inner peripheral surface of the casing and the flow path forming surface.

A compressor pertaining to a ninth aspect of the present invention is the compressor pertaining to any one of the second aspect to the fourth aspect, wherein the flow path forming member is formed with part of it being inclined in such a way that the quantity of the lubricating oil flowing through the oil flow path and in contact with the flow path forming member increases.

In the compressor pertaining to the ninth aspect, the flow path forming member has a section that is inclined in the radial direction of the casing. Because of this, when the lubricating oil flows through the oil flow path, the lubricating oil comes into contact with the inclined section of the flow path forming member, whereby the quantity of the lubricating oil coming into contact with the flow path forming member increases. Consequently, the heat of the lubricating oil is easily transmitted to the flow path forming member. Further, in this compressor, the flow path forming member has the section contiguous to the inner peripheral surface of the casing, so the heat of the lubricating oil is indirectly transmitted to the casing via the flow path forming member. Consequently, the temperature measuring mechanism can more appropriately measure the temperature of the lubricating oil.

In the compressor pertaining to the ninth aspect, in a case where the temperature of the lubricating oil that the temperature measuring mechanism has measured has reached a predetermined temperature or more, it is judged that the temperature inside the compressor has risen abnormally and the operation of the compressor is stopped, whereby the reliability of the compressor can be improved.

A compressor pertaining to a tenth aspect of the present invention is the compressor pertaining to any one of the second aspect, the third aspect, the fourth aspect, and the ninth aspect, wherein the oil flow path is a space sandwiched between the casing and the flow path forming member.

In the compressor pertaining to the tenth aspect, all the space configuring the oil flow path is contiguous to the inner peripheral surface of the casing. That is, the lubricating oil flowing through the oil flow path easily comes into contact with the inner peripheral surface of the casing, so the temperature measuring mechanism can more appropriately measure the temperature of the lubricating oil.

In the compressor pertaining to the tenth aspect, in a case where the temperature of the lubricating oil that the temperature measuring mechanism has measured has reached a predetermined temperature or more, it is judged that the temperature inside the compressor has risen abnormally and the operation of the compressor is stopped, whereby the reliability of the compressor can be improved.

Advantageous Effects of Invention

With the compressor pertaining to the present invention, the reliability of a compressor can be improved by appropriately measuring the temperature inside the compressor.

DESCRIPTION OF EMBODIMENTS

First Embodiment

A compressor pertaining to a first embodiment of the present invention will be described with reference to FIG. 1 to FIG. 7. The compressor pertaining to the present embodiment is a high-pressure/low-pressure dome scroll compressor. The compressor pertaining to the present embodiment configures a refrigerant circuit together with a condenser, an expansion mechanism, an evaporator, and so forth and compresses refrigerant gas circulating in the refrigerant circuit.

<Configurations>

Figure 1:
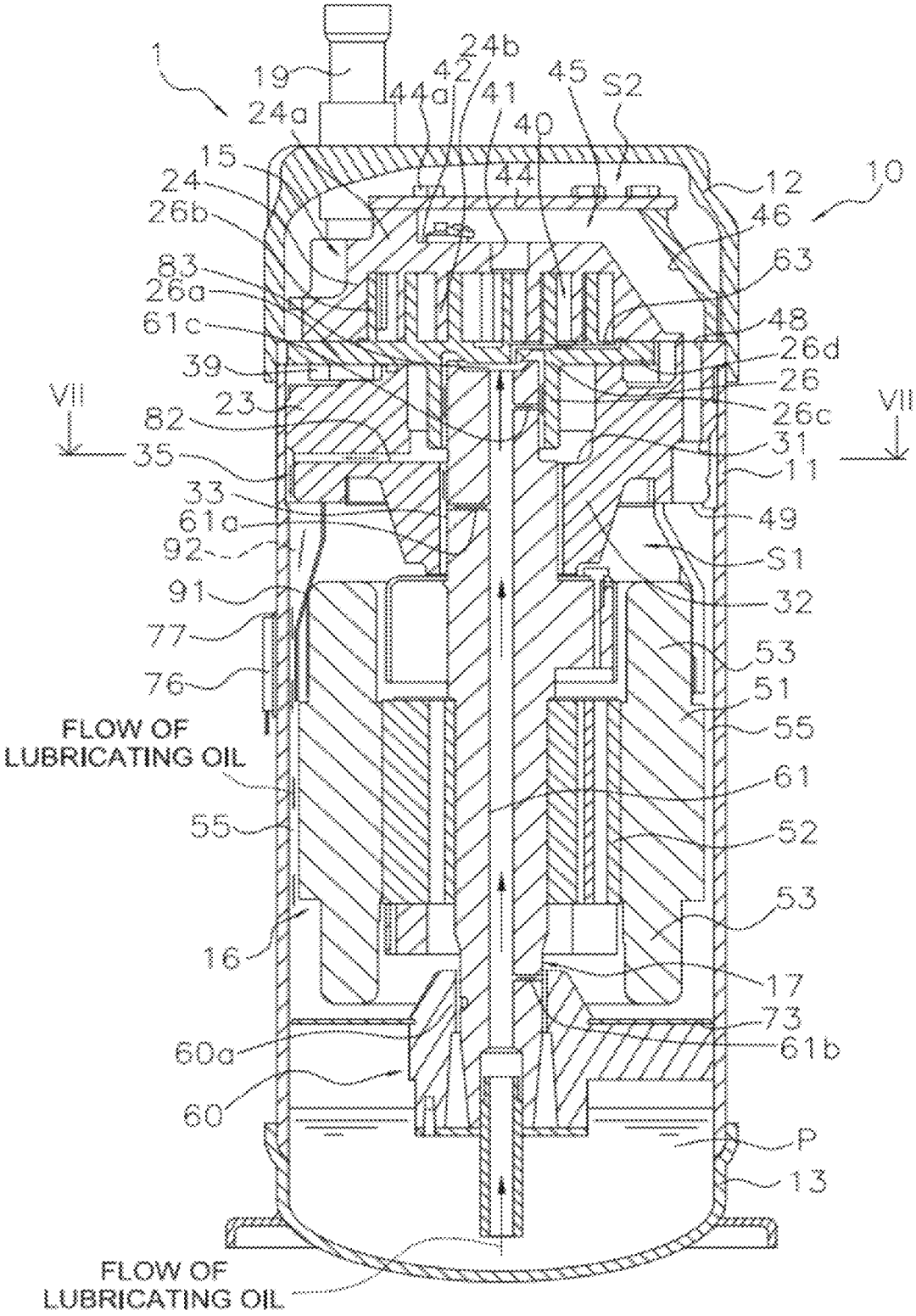
FIG. 1 is a longitudinal sectional view of a scroll compressor pertaining to a first embodiment of the present invention.

The configurations of a scroll compressor 1 pertaining to the present embodiment will be described. FIG. 1 shows a longitudinal sectional view of the scroll compressor 1. Each of the parts configuring the scroll compressor 1 will be described below.

(1) Casing

A casing 10 has a substantially cylindrical barrel casing portion 11, a bowl-shaped upper wall portion 12 that is air-tightly welded to the upper end portion of the barrel casing portion 11, and a bowl-shaped bottom wall portion 13 that is air-tightly welded to the bottom end portion of the barrel casing portion 11. The casing 10 is cast from a rigid member that does not easily become deformed or damaged in a case where pressure and temperature have changed inside and outside the casing 10. Further, the casing 10 is installed in such a way that the substantially cylindrical axial direction of the barrel casing portion 11 is along the vertical direction. A compression mechanism 15 that compresses refrigerant, a motor 16 that is placed under the compression mechanism 15, and a drive shaft 17 that is placed in such a way as to extend in the up-and-down direction inside the casing 10 and others are housed inside the casing 10. Further, a suction tube 19 and a discharge tube (not illustrated) described later are air-tightly joined to the casing 10.

(2) Compression Mechanism

The compression mechanism 15 is configured from a fixed scroll part 24 and an orbiting scroll part 26.

The fixed scroll part 24 has a first panel 24*a* and an involute first wrap 24*b* that is formed upright on the first panel 24*a*. A main intake hole (not illustrated) and an auxiliary intake hole (not illustrated) that is adjacent to the main intake hole are formed in the fixed scroll part 24. The later-described suction tube 19 and a later-described compression chamber 40 are communicated with each other by the main intake hole, and a later-described low-pressure space S2 and the later-described compression chamber 40 are communicated with each other by the auxiliary intake hole. Further, a discharge hole 41 is formed in the central portion of the first panel 24*a*, and a broad recessed portion 42 that is communicated with the discharge hole 41 is formed in the upper surface of the first panel 24*a*. The broad recessed portion 42 is configured by a recessed portion that is disposed recessed in the upper surface of the first panel 24*a* and is broad in the horizontal direction, Additionally, a cover 44 is fastened and fixed by a bolt 44*a*, in such a way as to close off the broad recessed portion 42, to the upper surface of the fixed scroll part 24. Additionally, a muffler space 45 comprising an expansion chamber that muffles the operating sound of the compression mechanism 15 is formed as a result of the cover 44 being disposed so as to cover the broad recessed portion 42. The fixed scroll part 24 and the cover 44 are sealed as a result of being brought into close contact with each other via packing (not illustrated). Further, a first connecting passageway 46 that is communicated with the muffler space 45 and opens to the undersurface of the fixed scroll part 24 is formed in the fixed scroll part 24.

The orbiting scroll part 26 is configured from a second panel 26*a* and an involute second wrap 26*b* that is formed upright on the second panel 26*a*. A second bearing portion 26*c* is formed in the central portion of the undersurface of the second panel 26*a*. Further, an oil feed pore 63 is formed in the second panel 26*a*. The oil feed pore 63 allows the outer peripheral portion of the upper surface of the second panel 26*a* and the space on the inner side of the second bearing portion 26*c* to be communicated with each other. The fixed scroll part 24 and the orbiting scroll part 26 form a compression chamber 40 that is enclosed by the first panel 24*a*, the first wrap 24*b*, the second panel 26*a*, and the second wrap 26*b* as a result of the first wrap 24*b* and the second wrap 26*b* meshing with each other.

(3) Main Frame

A main frame 23 is disposed under the compression mechanism 15 and is air-tightly joined, at its outer peripheral surface, to the inner wall of the casing 10. For this reason, the inside of the casing 10 is divided into a high-pressure space S1 under the main frame 23 and a low-pressure space S2 above the main frame 23. The main frame 23 has a main frame recessed portion 31 that is disposed recessed in the upper surface of the main frame 23 and a first bearing portion 32 that is disposed extending downward from the undersurface of the main frame 23. A first bearing hole 33 that penetrates the first bearing portion 32 in the up-and-down direction is formed in the first bearing portion 32. Further, the main frame 23 has the fixed scroll part 24 placed on it as a result of the fixed scroll part 24 being fixed to it with a bolt or the like and holds the orbiting scroll part 26 together with the fixed scroll part 24 via a later-described Oldham coupling 39.

The main frame 23 has an oil return passageway 82 that is formed in the horizontal direction from the center portion of the main frame 23 toward the outer peripheral portion of the main frame 23 and a secondary oil return passageway 35 that is formed in the vertical direction in the outer peripheral portion of the main frame 23. The oil return passageway 82 is communicated with the bottom portion of the main frame recessed portion 31 and the secondary oil return passageway 35, and the secondary oil return passageway 35 is communicated with the oil return passageway 82 and a later-described oil flow path 92.

The main frame 23 has a second connecting passageway 48 that is formed penetrating the outer peripheral portion of the main frame 23 in the vertical direction. The second connecting passageway 48 is communicated with the first connecting passageway 46 at the upper surface of the main frame 23 and is communicated with the high-pressure space S1 via a discharge port 49 at the undersurface of the main frame 23.

(4) Oldham Coupling

The Oldham coupling 39 is a ring-shaped member for preventing auto-rotational motion of the orbiting scroll part 26 and is fitted into an oval-shaped Oldham groove 26*d* formed in the main frame 23.

(5) Motor

The motor 16 is a brushless DC motor disposed under the main frame 23. The motor 16 is a distributed winding motor configured by a stator 51 that is fixed to the inner wall of the casing 10 and a rotor 52 that is housed, in such a way that it may freely rotate, with a slight gap on the inner side of the stator 51.

Copper wire is coiled around the teeth portion of the stator 51, and coil ends 53 are formed above and below the stator 51. Further, core cut portions that are cut away and formed in plural places from the upper end surface to the lower end surface of the stator 51 and at predetermined intervals in the circumferential direction are disposed in the outer peripheral surface of the stator 51. Additionally, a motor cooling passageway 55 that extends in the up-and-down direction between the barrel casing portion 11 and the stator 51 is formed by the core cut portions.

The rotor 52 is connected, a its center of rotation, to the orbiting scroll part 26 via the later-described drive shaft 17.

(6) Secondary Frame

A secondary frame 60 is disposed under the motor 16. The secondary frame 60 is fixed to the barrel casing portion 11 and has a third bearing portion 60*a*.

(7) Oil Separating Plate

An oil separating plate 73 is a plate-like member that is placed under the motor 16 inside the casing 10 and is fixed to the upper surface side of the secondary frame 60, The oil separating plate 73 separates out lubricating oil included in the compressed refrigerant descending inside the high-pressure space S1. The lubricating oil that has been separated out falls downward to an oil pool P in the bottom portion of the casing 10.

(8) Drive Shaft

The drive shaft 17 interconnects the compression mechanism 15 and the motor 16 and is placed in such a way as to extend in the up-and-down direction inside the casing 10. The drive shaft 17 penetrates the first bearing hole 33 in the main frame 23. The upper end portion of the drive shaft 17 fits into the second bearing portion 26*c* of the orbiting scroll part 26. The lower end portion of the drive shaft 17 is positioned in the oil pool P. An oil feed path 61 that penetrates the drive shaft 17 in its axial direction is formed inside the drive shaft 17. The oil feed path 61 is communicated with an oil chamber 83 formed by the upper end surface of the drive shaft 17 and the undersurface of the second panel 26*a*. The oil chamber 83 is communicated with a sliding portion (hereinafter called "the sliding portion of the compression mechanism 15") between the fixed scroll part 24 and the orbiting scroll part 26 via the oil teed pore 63 in the second panel 26*a* and eventually leads to the low-pressure space S2.

Further, the drive shaft 17 has a first transverse oil feed hole 61*a*, a second transverse oil feed hole 61*b*, and a third transverse oil feed hole 61*c* for supplying lubricating oil to the first bearing portion 32, the third bearing portion 60*a*, and the second bearing portion 26*c*, respectively.

(9) Oil Return Plate

Figure 2:
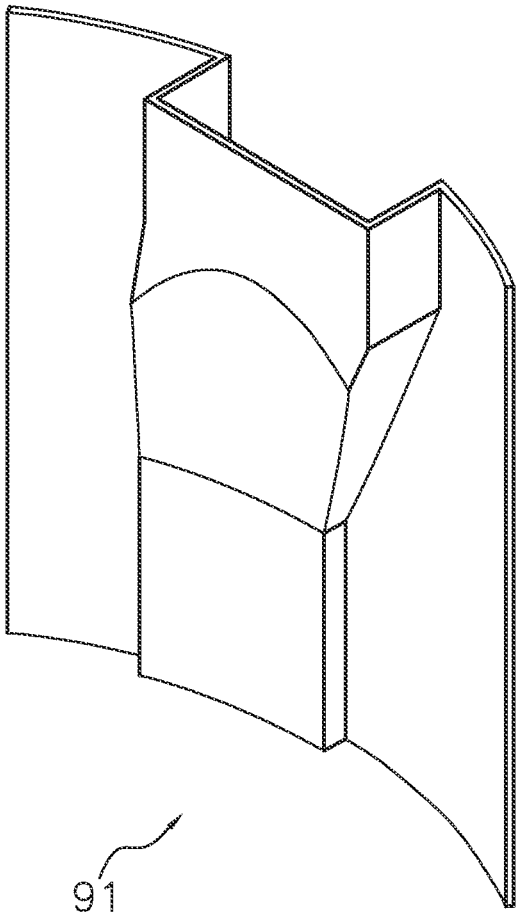
FIG. 2 is a perspective view of an oil return plate pertaining to the first embodiment of the present invention.
Figure 3:
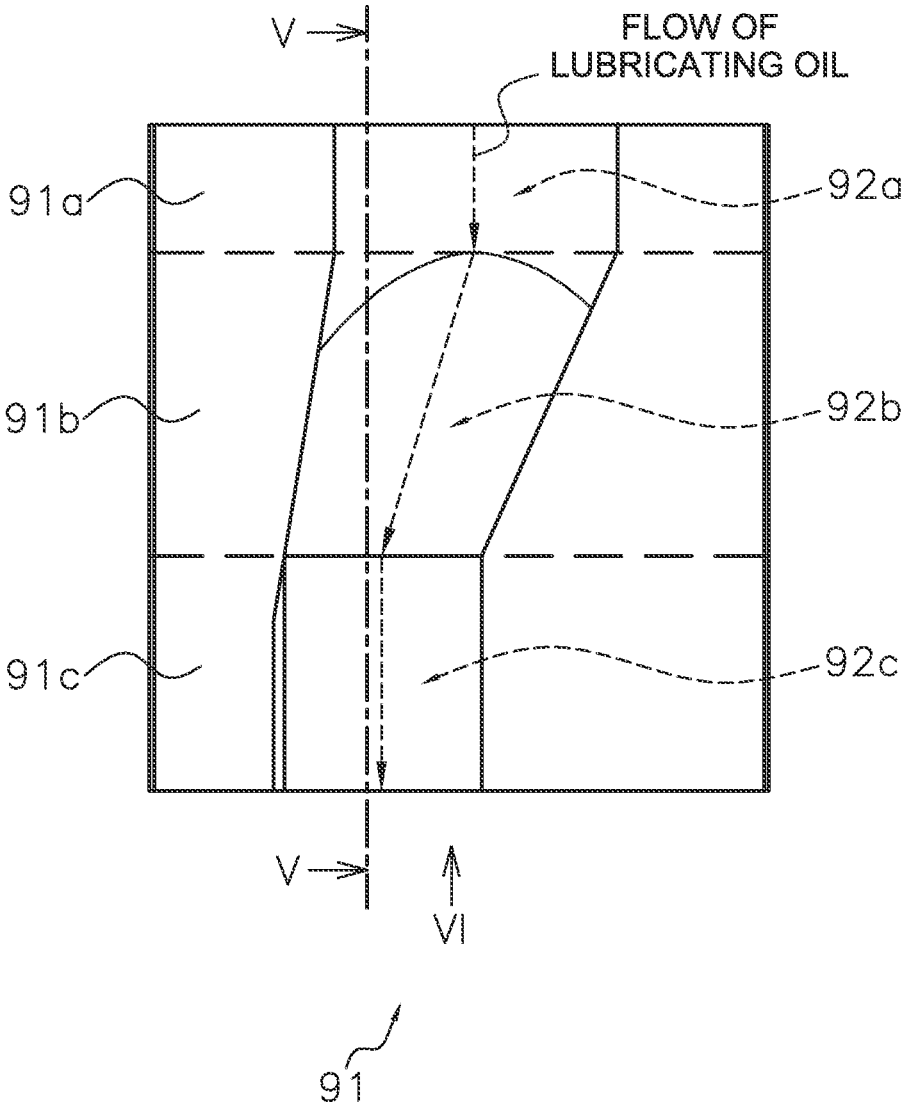
FIG. 3 is a front view of the oil return plate pertaining to the first embodiment of the present invention.
Figure 4:
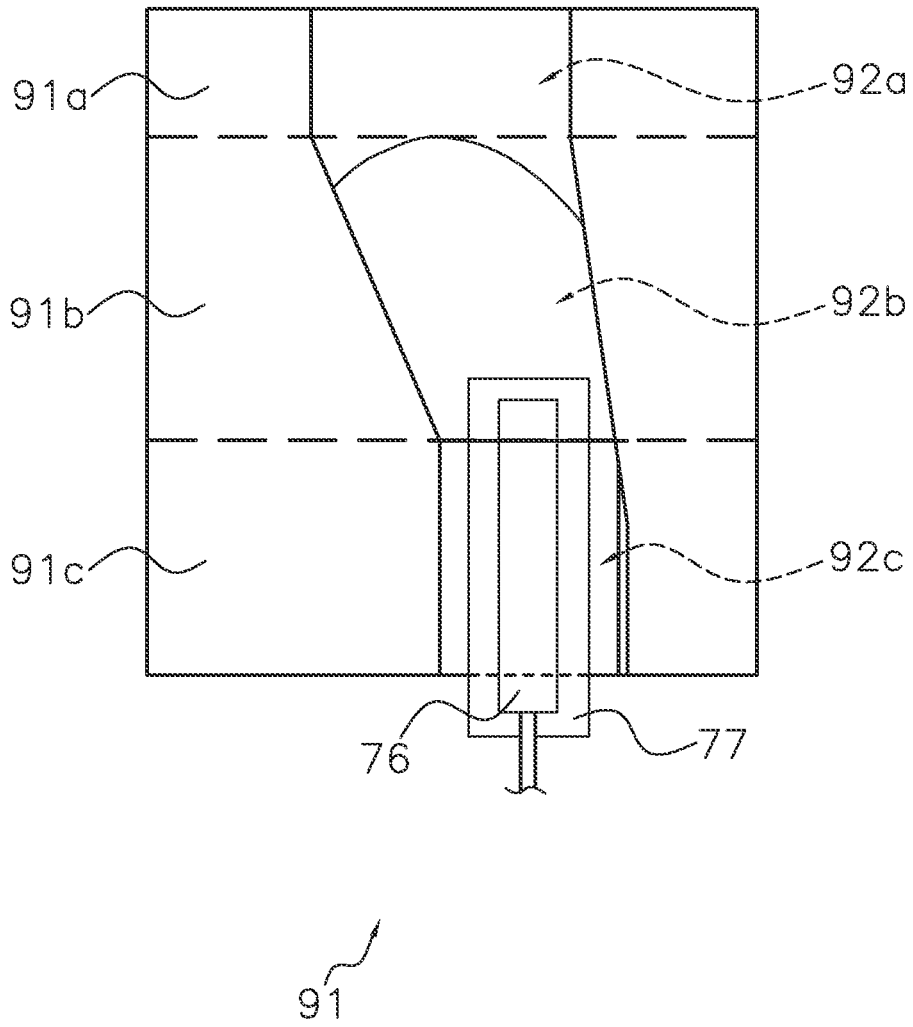
FIG. 4 is a rear view of the oil return plate pertaining to the first embodiment of the present invention as seen from arrow IV in FIG. 5.
Figure 5:
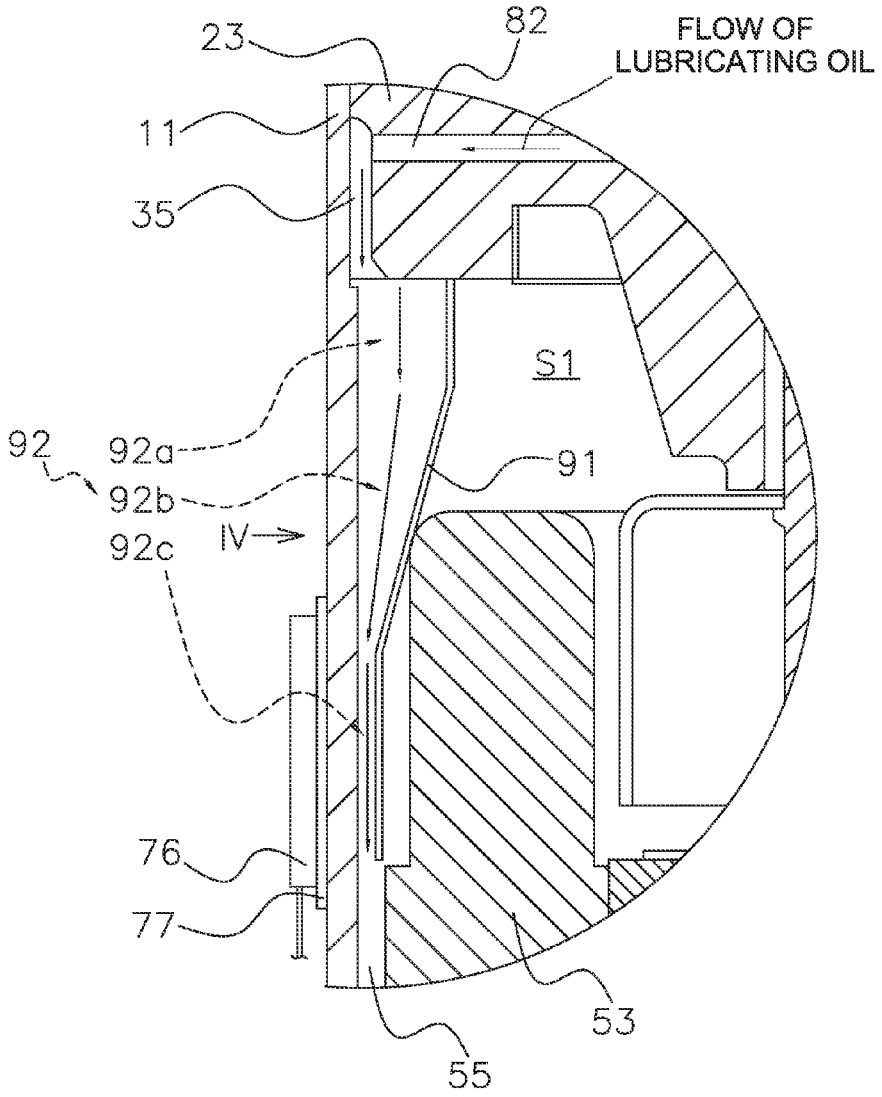
FIG. 5 is a longitudinal sectional view of the oil return plate pertaining to the first embodiment of the present invention in line segment V-V in FIG. 3.
Figure 6:
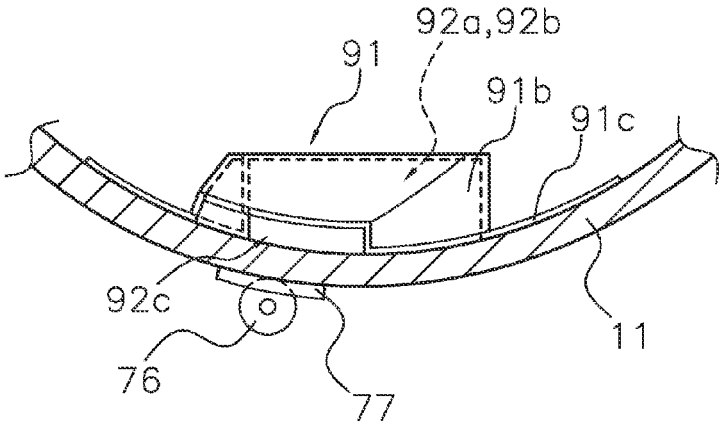
FIG. 6 is a bottom view of the oil return plate pertaining to the first embodiment of the present invention as seen from arrow VI in FIG. 3.
Figure 7:
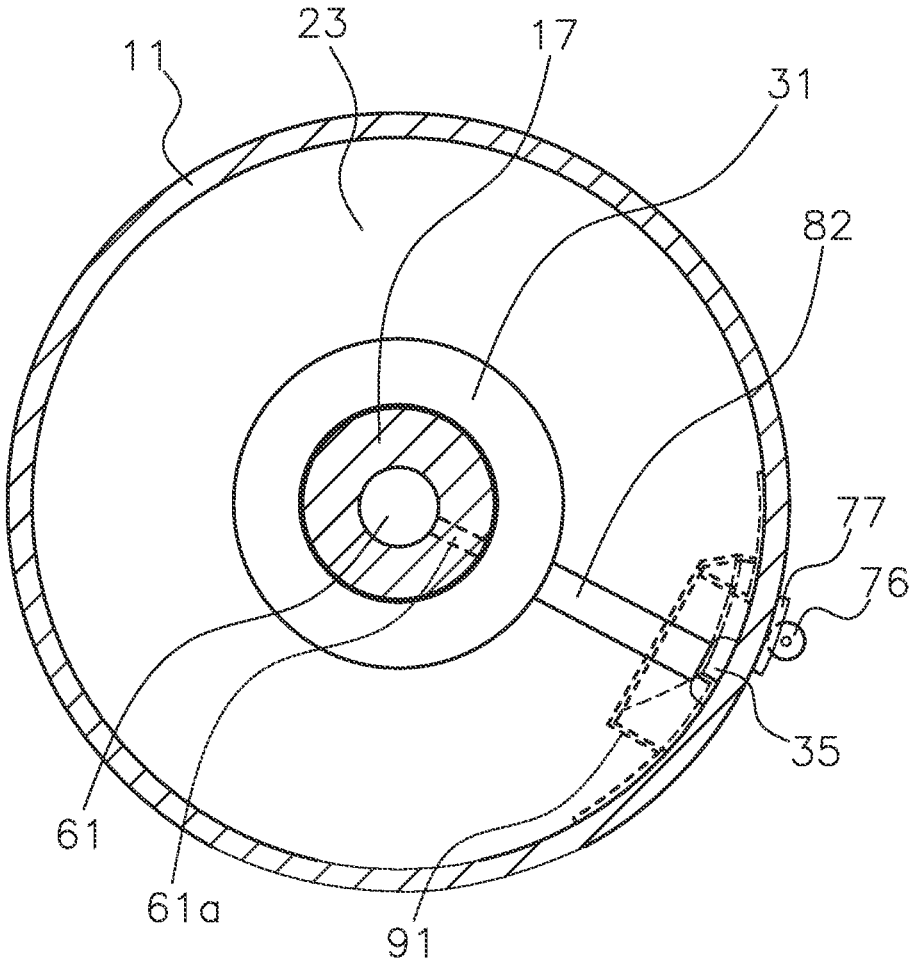
FIG. 7 is a transverse sectional view of the scroll compressor pertaining to the first embodiment of the present invention in line segment VII-VII in FIG. 1.

An oil return plate 91 is a member that forms an oil flow path 92 that is a space that allows the secondary oil return passageway 35 in the main frame 23 and the motor cooling passageway 55 to be communicated with each other. The oil return plate 91 is disposed in the high-pressure space S1 between the main frame 23 and the motor 16. FIG. 2 shows a perspective view of the oil return plate 91. FIG. 3 and FIG. 4 show a front view and a rear view of the oil return plate 91, respectively. FIG. 4 is a rear view of the oil return plate 91 as seen from arrow IV in FIG. 5 described later, and a temperature sensor 76 and a temperature sensor holding plate 77 described later are depicted in FIG. 4. FIG. 5 shows a longitudinal sectional view of the oil return plate 91 in V-V FIG. 3 and shows the structure of the neighborhood thereof. FIG. 6 shows a bottom view of the oil return plate 91 as seen from arrow VI in FIG. 3 and shows the structure of the neighborhood thereof. FIG. 7 shows a transverse sectional view of the scroll compressor 1 along VII-VII in FIG. 1.

Both horizontal direction end portions of the oil return plate 91 are closely fixed to the inner peripheral surface of the barrel casing portion 11 (hereinafter called "the casing inner peripheral surface"). For that reason, as shown in FIG. 6, the side of the oil return plate 91 contiguous to the casing inner peripheral surface is formed in a circular arc shape in a case where the oil return plate 91 is seen from an above point of view. In FIG. 3, the side of the oil return plate 91 contiguous to the casing inner peripheral surface is depicted.

As shown in FIG. 3 to FIG. 5, the oil return plate 91 is configured from an upper flow path forming portion 91*a*, a central inclined flow path forming portion 91*b*, and a lower flow path forming portion 91*c*. The oil return plate 91 is formed as a result of the upper flow path forming portion 91*a*, the central inclined flow path forming portion 91*b*, and the lower flow path forming portion 91*c* being integrally shaped out of sheet metal, for example.

The oil flow path 92 is a space sandwiched by the oil return plate 91 and the casing inner peripheral surface. The oil flow path 92 is configured from an upper flow path 92*a*, a central inclined flow path 92*b*, and a lower flow path 92*c*. The upper flow path 92*a* is a space sandwiched by the upper flow path forming portion 91*a* and the casing inner peripheral surface. The central inclined flow path 92*b* is a space sandwiched by the central inclined flow path forming portion 91*b* and the casing inner peripheral surface. The lower flow path 92*c* is a space sandwiched by the lower flow path forming portion 91*c* and the casing inner peripheral surface. As shown in FIG. 3 and FIG. 4, the upper flow path 92*a* is communicated with the central inclined flow path 92*b*, and the central inclined flow path 92*b* is communicated with the lower flow path 92*c*. Further, as shown in FIG. 5, the upper flow path 92*a* is communicated with the secondary oil return passageway 35, and the lower flow path 92*c* is communicated with the motor cooling passageway 55. As shown in FIG. 6, the cross sections of the upper flow path 92*a* and the lower flow path 92*c* have substantially flat shapes extending along the circumferential direction of the casing 10.

As shown in FIG. 6, the oil return plate 91 is formed in such a way that the cross-sectional area of the lower flow path 92*c* is smaller than the cross-sectional area of the upper flow path 92*a*. The reason for this is because the width, in the radial direction of the casing 10, of the motor cooling passageway 55 communicated with the lower flow path 92*c* is smaller than the width, in the radial direction of the casing 10, of the high-pressure space S1 directly under the secondary oil return passageway 35 communicated with the upper flow path 92*a*.

Further, as shown in FIG. 6, the oil return plate 91 is formed in such a way that the cross section of the lower flow path 92*c* is placed in an off-center position with respect to the cross section of the upper flow path 92*a*. In other words, the center of gravity of the horizontal cross-sectional shape of the lower flow path 92*c* does not exist on a straight line joining the center of the horizontal cross-sectional shape of the barrel casing portion 11 and the center of gravity of the horizontal cross-sectional shape of the upper flow path 92*a*.

Further, the oil return plate 91 is formed in such a way that the width of the central inclined flow path 92*b* in the radial direction of the casing 10—that is, the horizontal direction distance between the central inclined flow path forming portion 91*b* and the casing inner peripheral surface—becomes smaller from above to below. That is, as shown in FIG. 5, the flow path width of the oil flow path 92 in the radial direction of the casing 10 has a section that becomes smaller from the upper portion to the lower portion.

(10) Suction Tube

The suction tube 19 is a tubular member for guiding the refrigerant to the compression mechanism 15 and is air-tightly fitted into the upper wall portion 12.

(11) Discharge Tube

The discharge tube is a tubular member for discharging the refrigerant in the high-pressure space S1 from the casing 10 and is air-tightly fitted into the barrel casing portion 11.

(12) Temperature Sensor

As shown in FIG. 5 to FIG. 7, the temperature sensor 76 is fixed to the outer peripheral surface of the barrel casing portion 11 (hereinafter called "the casing outer peripheral surface") by the temperature sensor holding plate 77. The temperature sensor holding plate 77 is fixed to the casing outer peripheral surface by spot welding, for example. The temperature sensor 76 measures the temperature of the casing outer peripheral surface in the position where the temperature sensor holding plate 77 is fixed.

FIG. 5 shows the positional relationship between the oil return plate 91 and the temperature sensor 76 in the vertical direction, and FIG. 6 and FIG. 7 show the positional relationship between the oil return plate 91 and the temperature sensor 76 in the horizontal direction. As shown in FIG. 5 to FIG. 7, the temperature sensor 76 is fixed to a section of the casing outer peripheral surface corresponding to the back side of a section of the casing inner peripheral surface contiguous to the lower flow path 92*c*.

<Actions>

The actions of the scroll compressor 1 pertaining to the present embodiment will be described. Specifically, the process by which the lubricating oil flows inside the casing 10 and the process by which the heat of the lubricating oil flowing inside the casing 10 is transmitted to the casing outer peripheral surface will be described.

First, the process by which the lubricating oil flows inside the casing 10 will be described.

The lubricating oil is stored in the oil pool P located in the bottom portion of the casing 10. The lower end portion of the oil feed path 61 disposed in the drive shaft 17 is immersed in the lubricating oil in the oil pool P. The lower end portion of the oil feed path 61 is under the pressure in the high-pressure space S1 because the oil pool P is located in the high-pressure space S1 into which the refrigerant that has been compressed by the compression mechanism 15 is discharged. The upper end portion of the oil feed path 61 is communicated with the oil feed pore 63 via the oil chamber 83. The oil feed pore 63 is communicated with the compression chamber 40 formed by the fixed scroll part 24 and the orbiting scroll part 26. The compression chamber 40 is a space for the refrigerant to be compressed in, so it is under a lower pressure than the pressure in the high-pressure space S1 into which the compressed refrigerant is discharged. Consequently, the pressure in the upper end portion of the oil feed path 61 is lower than the pressure in the lower end portion of the oil feed path 61. Because of this, when the scroll compressor 1 starts up and the refrigerant is compressed in the compression mechanism 15, the lubricating oil stored in the oil pool P rises inside the oil feed path 61 because of the differential pressure generated inside the oil feed path 61. Further, the lubricating oil stored in the oil pool P also rises inside the oil feed path 61 because of the centrifugal pumping action resulting from the axial rotational motion of the drive shaft 17.

Some of the lubricating oil rising in the oil feed path 61 is supplied to the first transverse oil feed hole 61*a*, the second transverse oil feed hole 61*b*, and the third transverse oil feed hole 61*c* and lubricates the first bearing portion 32, the third bearing portion 60*a*, and the second bearing portion 26*c*, respectively. The lubricating oil that has risen as far as the upper end portion of the oil feed path 61 is supplied to the oil chamber 83 and lubricates the sliding portion of the compression mechanism 15 via the oil feed pore 63.

The lubricating oil that has lubricated the second bearing portion 26*c* via the third transverse oil feed hole 61*c* and the oil chamber 83 is stored in the bottom portion of the main frame recessed portion 31. Thereafter, the lubricating oil flows through the oil return passageway 82 disposed in the main frame 23, falls downward through the secondary oil return passageway 35, and is supplied to the oil flow path 92. The lubricating oil flowing from above to below through the oil flow path 92 falls downward to the oil pool P via the motor cooling passageway 55.

Further, oil droplets of the lubricating oil are included in the compressed refrigerant discharged from the compression mechanism 15 into the high-pressure space S1. The oil droplets of the lubricating oil are separated out from the compressed refrigerant by the oil separating plate 73 and fall downward to the oil pool P.

Next, the process by which the heat of the lubricating oil flowing inside the casing 10 is transmitted to the casing outer peripheral surface will be described. When the lubricating oil rises in the oil feed path 61, the lubricating oil absorbs the heat generated by the sliding of the drive shaft 17 in the first bearing portion 32, the third bearing portion 60*a*, and the second bearing portion 26*c* and the heat produced by the rotation of the rotor 52. Consequently, the lubricating oil flowing through the oil flow path 92 is lubricating oil that has reached a high temperature because of the operating action of the scroll compressor 1.

In the oil flow path 92, the flow path cross-sectional area of the lower flow path 92*c* is smaller than the flow path cross-sectional areas of the upper flow path 92*a* and the central inclined flow path 92*b*, Consequently, the flow rate per unit time of the lubricating oil flowing through the lower flow path 92*c* is smaller than the flow rates of the lubricating oil flowing through the upper flow path 92*a* and the central inclined flow path 92*b*. Because of this, the flow speed of the lubricating oil flowing from above to below through the oil flow path 92 is reduced in the lower flow path 92*c*. Consequently, the amount of time in which the lubricating oil is in contact with the casing inner peripheral surface and the lower flow path forming portion 91*c* that form the lower flow path 92*c* is longer than the amount of time in which the lubricating oil is in contact with the sections that form the upper flow path 92*a* and the central inclined flow path 92*b*, For that reason, the section of the casing outer peripheral surface corresponding to the back side of the section of the casing inner peripheral surface contiguous to the lower flow path 92*c* and the lower flow path forming portion 91*c* (hereinafter, in the present embodiment, this section will be called "the temperature measuring region") is a section to which the heat of the lubricating oil flowing through the oil flow path 92 is more efficiently transmitted compared to other sections of the casing outer peripheral surface.

Further, as shown in FIG. 4, the horizontal cross section of the lower flow path 92*c* has a substantially flat shape extending along the circumferential direction of the casing 10. Consequently, the lubricating oil flowing through the lower flow path 92*c* easily comes into contact with the casing inner peripheral surface that forms the lower flow path 92*c*. Moreover, even in a case where the quantity of the lubricating oil flowing through the oil flow path 92 is small, such as immediately after the startup of the scroll compressor 1, the lower flow path 92*c* is easily filled with the lubricating oil because its flow path cross-sectional area is small. That is, the lubricating oil flowing through the lower flow path 92*c* easily comes into contact with the casing inner peripheral surface and the lower flow path forming portion 91*c* that form the lower flow path 92*c*. Consequently, the heat of the lubricating oil flowing through the oil flow path 92 is more efficiently transmitted to the temperature measuring region compared to other sections of the casing outer peripheral surface.

Further, as described above, the section of the central inclined flow path forming portion 91*b* that opposes the casing inner peripheral surface is inclined toward the outer peripheral side of the casing 10 heading downward. Because of this, some of the lubricating oil flowing from above to below through the central inclined flow path 92*b* flows down the inclined section that opposes the casing inner peripheral surface. For that reason, the heat of the lubricating oil is transmitted to the entire oil return plate 91 via the inclined section that opposes the casing inner peripheral surface. Consequently, the heat of the lubricating oil flowing through the oil flow path 92 is efficiently transmitted to the temperature measuring region.

In the present embodiment, as shown in FIG. 5 to FIG. 7, the temperature sensor 76 is fixed to the section of the casing outer peripheral surface corresponding to the back side of the section of the casing inner peripheral surface contiguous to the lower flow path 92*c* and which is part of the temperature measuring region. Consequently, the heat of the lubricating oil flowing through the lower flow path 92*c* is transmitted to the temperature sensor 76 via just the barrel casing portion 11, so the temperature sensor 76 can appropriately measure the temperature of the lubricating oil flowing through the oil flow path 92.

<Characteristics>

Usually, an abnormality that has arisen during the operating action of the scroll compressor 1 tends to trigger an abnormal rise in the temperature of the lubricating oil flowing inside the scroll compressor 1. For example, if the sliding between the fixed scroll part 24 and the orbiting scroll part 26 is no longer smoothly carried out as a result of the leading end portion of the first wrap 24*b* of the fixed scroll part 24 becoming damaged, there is the potential for frictional heat to be produced at the damaged place and for the temperature of the lubricating oil to rise. Further, if the sliding in the first bearing portion 32 is no longer smoothly carried out as a result of the drive shaft 17 becoming worn, there is the potential for frictional heat to be produced and for the temperature of the lubricating oil to rise as a result of the drive shaft 17 colliding with the first bearing portion 32 during its axial rotation. Further, if the value of the electrical current flowing in the motor 16 rises abnormally as a result of the operating load of the scroll compressor 1 becoming excessive, the temperature of the motor 16 rises abnormally and the temperature of the lubricating oil also rises. With the scroll compressor 1 pertaining to the present embodiment, the reliability of the scroll compressor 1 can be improved by appropriately measuring the temperature of the lubricating oil.

In the scroll compressor 1 pertaining to the present embodiment, the high-temperature lubricating oil that has lubricated the sliding portions inside the casing 10 flows through the oil flow path 92 formed by the oil return plate 91. The heat of the lubricating oil flowing through the oil flow path 92 is efficiently transmitted to the temperature measuring region of the casing outer peripheral surface as described above. The temperature sensor 76 can appropriately measure the temperature of the lubricating oil flowing inside the scroll compressor 1 by measuring the temperature of the temperature measuring region.

<Modifications>

The first embodiment of the present invention has been described above with reference to the drawings, but the specific configurations of the present invention can be changed without departing from the gist of the present invention. Adaptable modifications with respect to the compressor pertaining to the embodiment will be described below.

(1) Modification 1A

In the scroll compressor 1 pertaining to the present embodiment, the temperature sensor 76 is fixed to the temperature measuring region that is the casing outer peripheral surface, but the temperature sensor 76 may also be implanted inside the casing 10, For example, a through hole may be formed in the outer wall of the barrel casing portion 11 located at the height of the oil flow path 92, and a copper tube inside of which a temperature sensor has been installed may be inserted in the through hole. Because of this, the temperature sensor can more accurately measure the temperature of the lubricating oil inside.

(2) Modification 1B

In the scroll compressor 1 pertaining to the present embodiment, the temperature sensor 76 has a mechanism that measures the temperature of the temperature measuring region of the casing 10, but the temperature sensor 76 may further include an operation shutdown mechanism. The operation shutdown mechanism is an electronic circuit, for example, that automatically starts up and shuts down the power source of the scroll compressor 1 in accordance with the measured temperature of the temperature measuring region of the casing 10, As the temperature sensor having the operation shutdown mechanism, a thermostat that utilizes a bimetal in which two metal plates with different coefficients of thermal expansion are adhered together may be used.

In the present modification, the operation shutdown mechanism judges that an abnormality has occurred in the operating action of the scroll compressor 1 and shuts down the operation of the scroll compressor 1 in a case where the temperature sensor has detected a temperature equal to or greater than a predetermined value. That is, the operation shutdown mechanism performs an action to protect the scroll compressor 1 by shutting down the operation of the scroll compressor 1 in a case where the temperature sensor has detected an abnormal rise in the temperature of the lubricating oil. Because of this, the reliability of the scroll compressor 1 can be improved.

(3) Modification 1C

Figure 8:
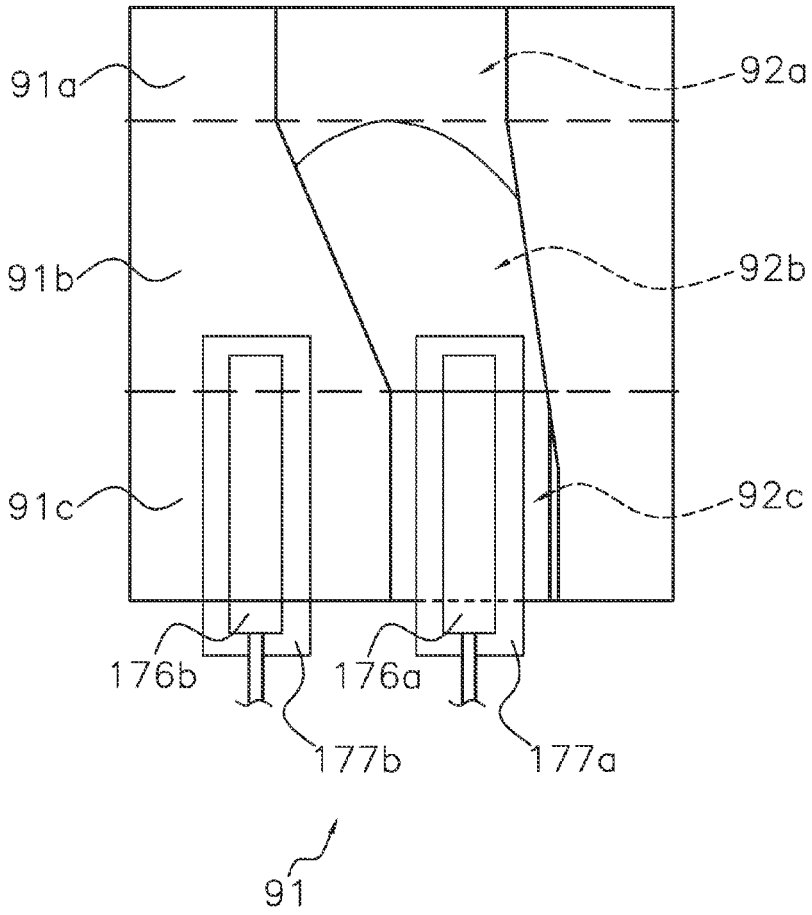
FIG. 8 is a rear view of the oil return plate pertaining to modification 1C of the first embodiment of the present invention.
Figure 9:
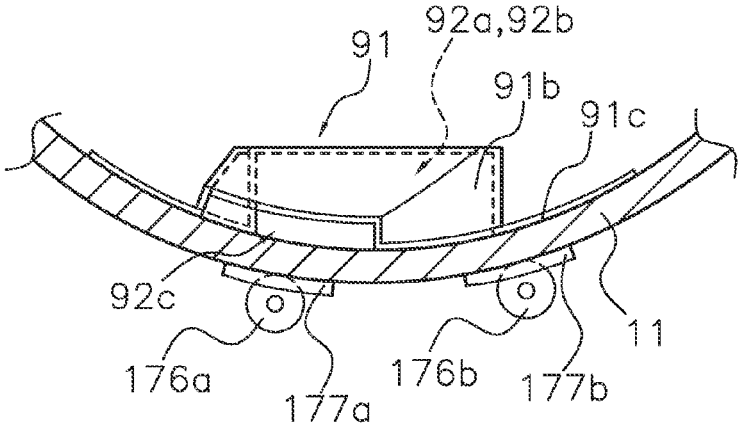
FIG. 9 is a bottom view of the oil return plate pertaining to modification 1C of the first embodiment of the present invention.

In the scroll compressor 1 pertaining to the present embodiment, the temperature sensor 76 is fixed to the section of the casing outer peripheral surface corresponding to the back side of the section of the casing inner peripheral surface contiguous to the lower flow path 92*c*, but the temperature sensor 76 may also be fixed to the section of the casing outer peripheral surface corresponding to the back side of the section of the casing inner peripheral surface contiguous to the lower flow path forming portion 91*c*. FIG. 8 and FIG. 9 show the positional relationship between the oil return plate 91 and the temperature sensor in this case. FIG.

8 is a rear view of the oil return plate pertaining to the present modification as seen from arrow IV in FIG. 5. FIG. 9 is a bottom view of the oil return plate pertaining to the present modification as seen from arrow VI in FIG. 3 and shows the structure of the neighborhood thereof.

In this scroll compressor, a temperature sensor 176*a* is fixed by a temperature sensor holding plate 177*a* to the section of the casing outer peripheral surface corresponding to the back side of the section of the casing inner peripheral surface contiguous to the lower flow path 92*c*, and a temperature sensor 176*b* is fixed by a temperature sensor holding plate 177*b* to the section of the casing outer peripheral surface corresponding to the back side of the section of the casing inner peripheral surface contiguous to the lower flow path forming portion 91*c*. In this scroll compressor, the temperature sensor 176*a* and the temperature sensor 176*b* are fixed to the temperature measuring region, so the temperature of the lubricating oil can be appropriately measured. Further, in this scroll compressor, two temperature sensors are used, so the reliability of the measurement of the temperature of the lubricating oil can be improved.

Further, the temperature sensor may also be fixed to the casing outer peripheral surface located in the neighborhood of the temperature measuring region in addition to the temperature measuring region.

Second Embodiment

A compressor pertaining to a second embodiment of the present invention will be described with reference to FIG. 10 to FIG. 12, A scroll compressor 101 pertaining to the present embodiment has configurations, actions, and characteristics shared in common with those of the scroll compressor 1 pertaining to the first embodiment. The differences between the scroll compressor 101 pertaining to the present embodiment and the scroll compressor 1 pertaining to the first embodiment will be mainly described.

<Configurations>

(1) Oil Return Plate

Figure 10:
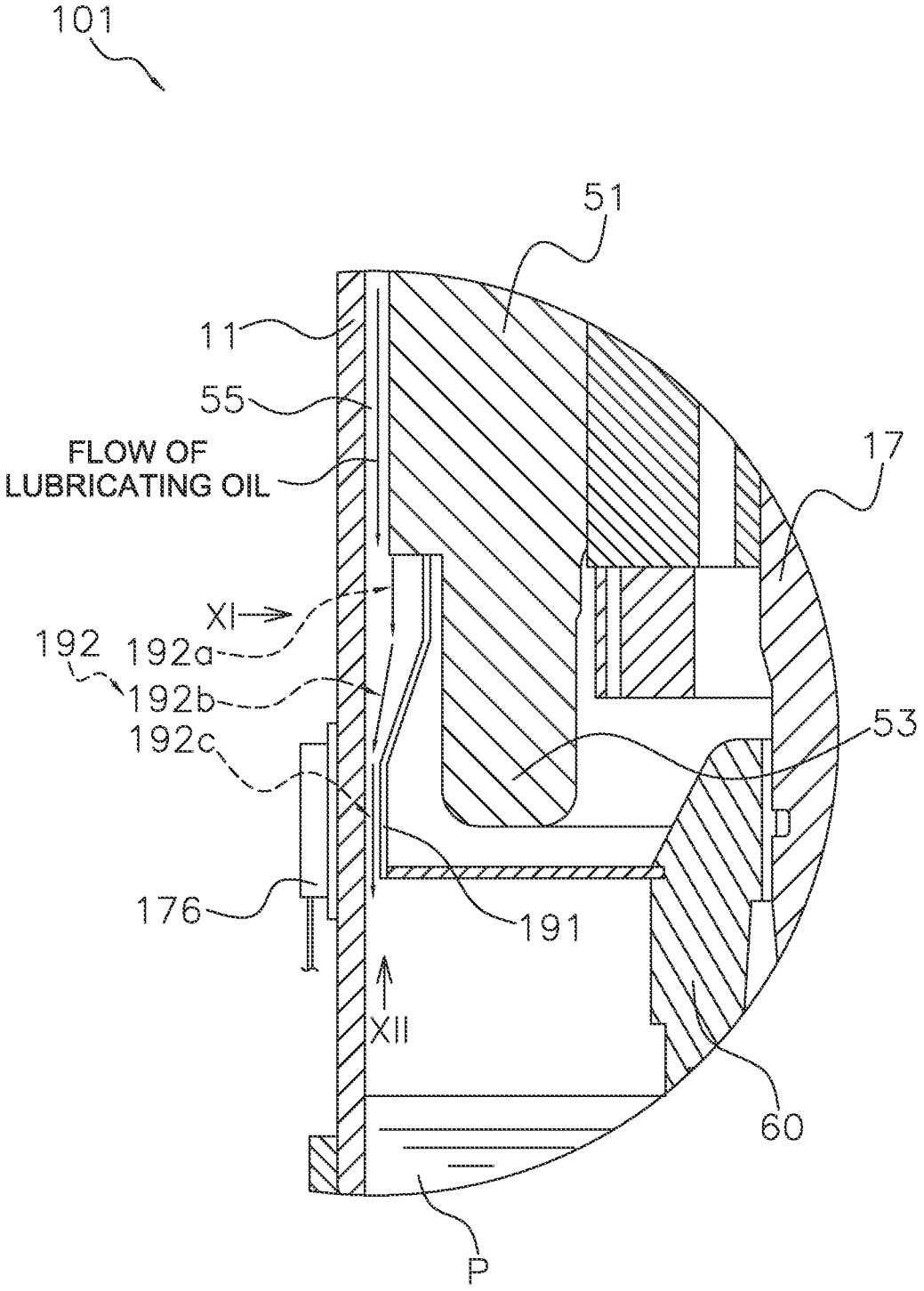
FIG. 10 is a longitudinal sectional view of an oil return plate pertaining to a second embodiment of the present invention.

As shown in FIG. 10, the scroll compressor 101 pertaining to the present embodiment is equipped with an oil return plate 191 that is disposed in the high-pressure space S1 under the motor 16 and forms an oil flow path 192. As described below, the oil return plate 191 has the same shape and function as those of the oil return plate 91 used in the first embodiment shown in FIG. 2.

Figure 11:
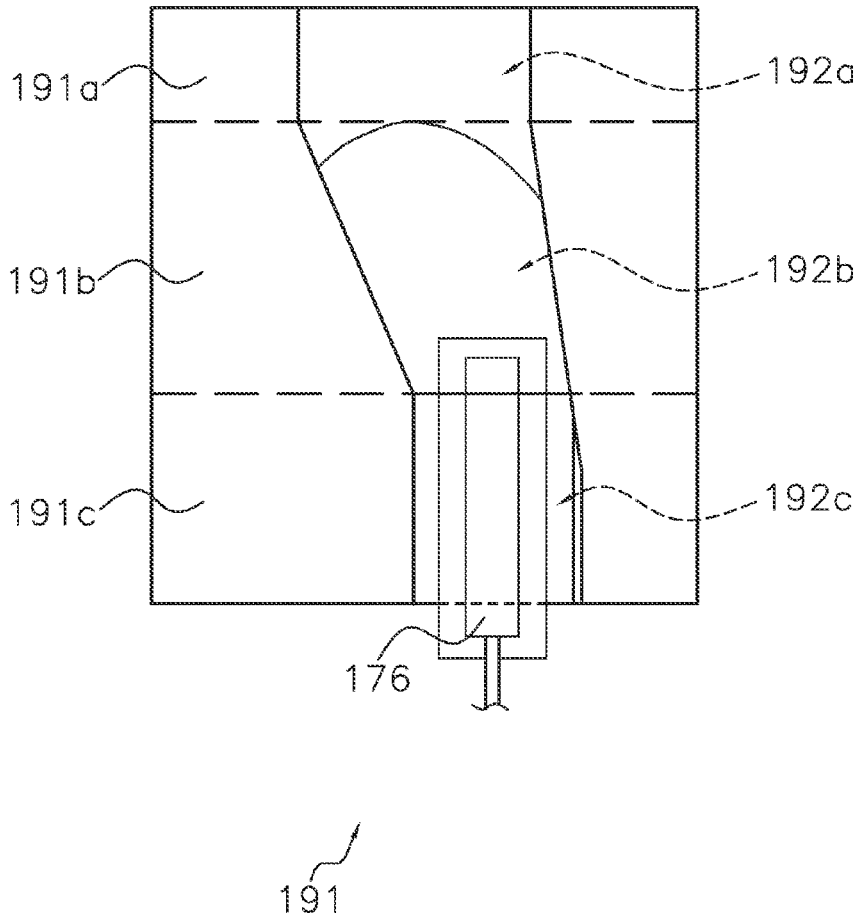
FIG. 11 is a rear view of the oil return plate pertaining to the second embodiment of the present invention as seen from arrow XI in FIG. 10.

As shown in FIG. 11, the oil return plate 191 is formed as a result of an upper flow path forming portion 191*a*, a central inclined flow path forming portion 191*b*, and a lower flow path forming portion 191*c* being integrally shaped out of sheet metal, for example. The oil flow path 192 is a space sandwiched by the oil return plate 191 and the casing inner peripheral surface. The oil flow path 192 is configured from an upper flow path 192*a*, a central inclined flow path 192*b*, and a lower flow path 192*c*. The upper flow path 192*a* is a space sandwiched by the upper flow path forming portion 191*a* and the casing inner peripheral surface. The central inclined flow path 192*b* is a space sandwiched by the central inclined flow path forming portion 191*b* and the casing inner peripheral surface. The lower flow path 192*c* is a space sandwiched by the lower flow path forming portion 191*c* and the casing inner peripheral surface. The upper flow path 192*a* is communicated with the central inclined flow path 192*b*, and the central inclined flow path 192*b* is communicated with the lower flow path 192*c*. The upper flow path 192*a* is communicated with the motor cooling passageway 55, and the lower flow path 192*c* is communicated with the oil pool R The cross sections of the upper flow path 192*a* and the lower flow path 192*c* have substantially flat shapes extending along the circumferential direction of the casing 10.

Figure 12:
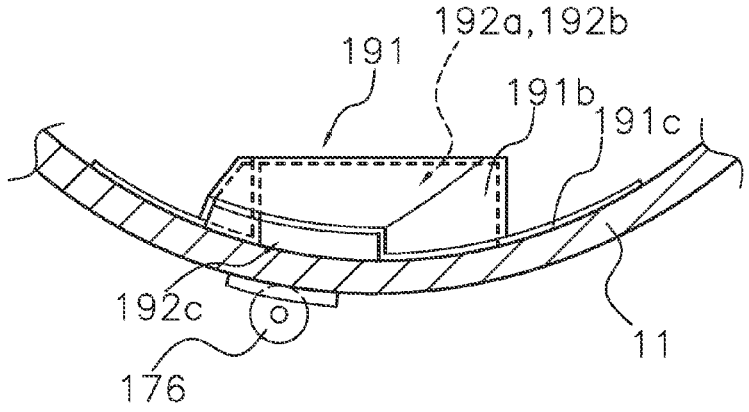
FIG. 12 is a bottom view of the oil return plate pertaining to the second embodiment of the present invention as seen from arrow XII in FIG. 10.

As shown in FIG. 12, the oil return plate 191 is formed in such a way that the cross-sectional area of the lower flow path 192*c* is smaller than the cross-sectional area of the upper flow path 192*a*. Further, the oil return plate 191 is formed in such a way that the width of the central inclined flow path 192*b* in the radial direction of the casing 10 that is, the horizontal direction distance between the central inclined flow path forming portion 191*b* and the casing inner peripheral surface—becomes smaller from above to below.

(2) Temperature Sensor

In the present embodiment, as shown in FIG. 10, a temperature sensor 176 is fixed to the casing outer peripheral surface. FIG. 11 shows the positional relationship between the oil return plate 191 and the temperature sensor 176 in the vertical direction, and FIG. 12 shows the positional relationship between the oil return plate 191 and the temperature sensor 176 in the horizontal direction. The temperature sensor 176 is fixed to the section of the casing outer peripheral surface corresponding to the back side of the section of the casing inner peripheral surface contiguous to the lower flow path 192*c*.

<Actions>

In the present embodiment, the lubricating oil that has passed through the motor cooling passageway 55 flows into the oil flow path 192. The lubricating oil flowing through the oil flow path 192 is lubricating oil that has reached a high temperature because of the operating action of the scroll compressor 101. In the present embodiment, like in the first embodiment, the section of the casing outer peripheral surface corresponding to the back side of the section of the casing inner peripheral surface contiguous to the lower flow path 192*c* and the lower flow path forming portion 191*c* (hereinafter, in the present embodiment, this section will be called "the temperature measuring region") is a region to which the heat of the lubricating oil flowing through the oil flow path 192 is more efficiently transmitted compared to other sections of the casing outer peripheral surface.

In the present embodiment, the temperature sensor 176 is fixed to the section of the casing outer peripheral surface corresponding to the back side of the section of the casing inner peripheral surface contiguous to the lower flow path 192*c* and which is part of the temperature measuring region. Consequently, the heat of the lubricating oil flowing through the lower flow path 192*c* is transmitted to the temperature sensor 176 via just the barrel casing portion 11, so the temperature sensor 176 can appropriately measure the temperature of the lubricating oil flowing through the oil flow path 192.

<Characteristics>

In the scroll compressor 101 pertaining to the present embodiment, the high-temperature lubricating oil that has lubricated the sliding portions inside the casing 10 flows through the oil flow path 192 formed by the oil return plate 191 and the casing inner peripheral surface. The heat of the lubricating oil flowing through the oil flow path 192 is efficiently transmitted to the temperature measuring region of the casing outer peripheral surface. The temperature sensor 176 can appropriately measure the temperature of the lubricating oil flowing inside the scroll compressor 101 by measuring the temperature of the temperature measuring region.

<Modifications>

The scroll compressor 101 pertaining to the present embodiment may further have the oil return plate 91 that the scroll compressor 1 pertaining to the first embodiment has. Modification 1A and modification 1B applied to the first embodiment may also be applied to the present embodiment.

Further, the temperature sensor 176 that the scroll compressor 101 pertaining to the present embodiment has may also measure the temperature of the temperature measuring region outside the section of the casing outer peripheral surface corresponding to the back side of the section of the casing inner peripheral surface contiguous to the lower flow path 192*c*.

Third Embodiment

A compressor pertaining to a third embodiment of the present invention will be described with reference to FIG. 13 to FIG. 15. A scroll compressor 201 pertaining to the present embodiment has configurations, actions, and characteristics shared in common with those of the scroll compressor 1 pertaining to the first embodiment. The differences between the scroll compressor 201 pertaining to the present embodiment and the scroll compressor 1 pertaining to the first embodiment will be mainly described.

<Configurations>

(1) Main Frame

Figure 13:
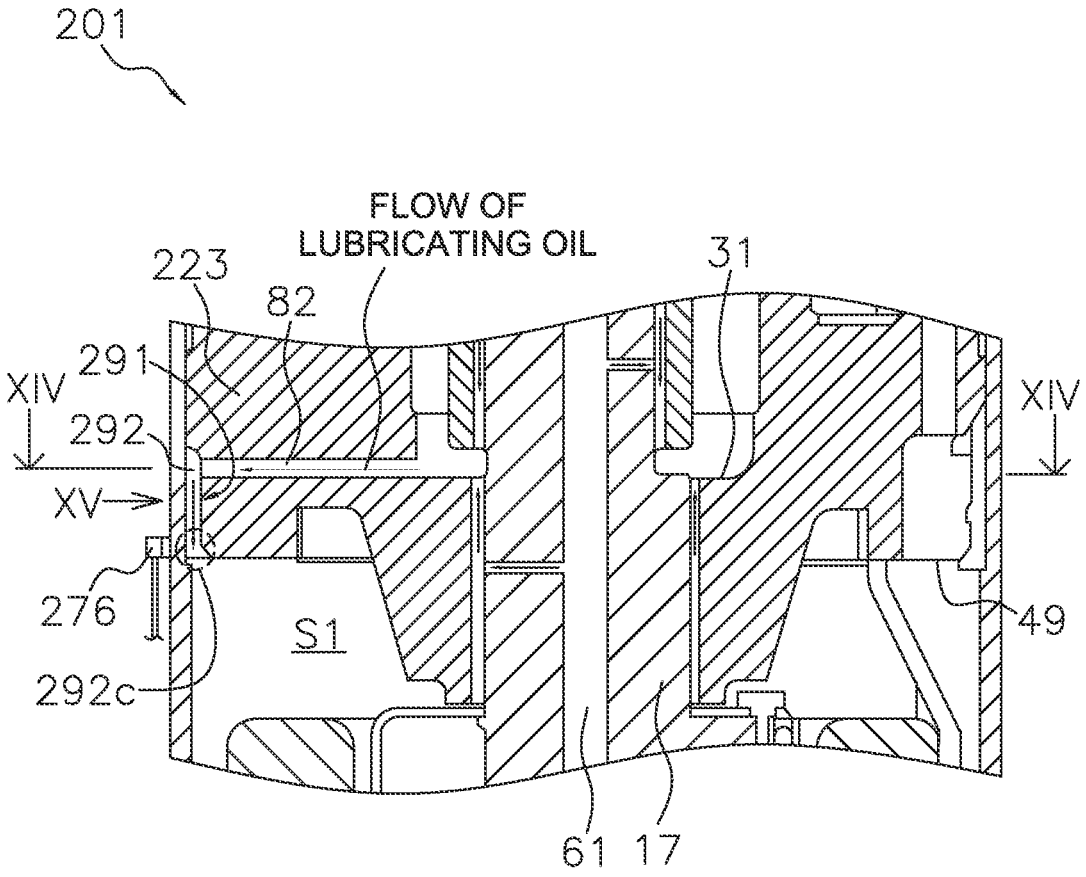
FIG. 13 is part of a longitudinal sectional view of a main frame pertaining to a third embodiment of the present invention.

In the scroll compressor 201 pertaining to the present embodiment, as shown in FIG. 13, a secondary oil return passageway 292 formed in an outer peripheral portion of a main frame 223 is a space between a flow path forming surface 291, which is part of a side surface of the main frame 223, and the casing inner peripheral surface. The flow path forming surface 291 is a surface that is spaced apart from and opposes the casing inner peripheral surface and to which the oil return passageway 82 opens.

Figure 15:
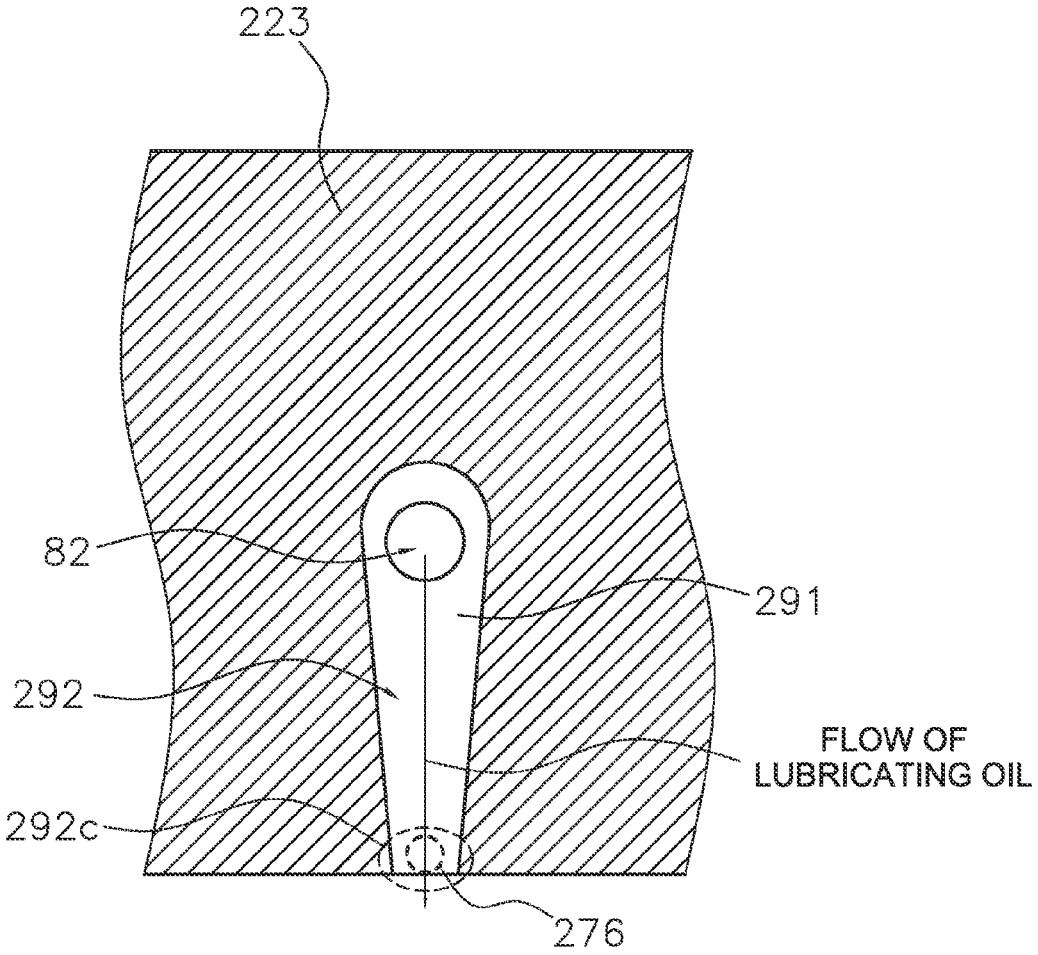
FIG. 15 is part of a side view of the main frame pertaining to the third embodiment of the present invention as seen from arrow XV in FIG. 13.

The secondary oil return passageway 292 has a shape where, in a case where the secondary oil return passageway 292 is seen along the radial direction of the casing 10 as shown in FIG. 15, the flow path width becomes smaller from above to below in the vertical direction. That is, the flow path resistance of the secondary oil return passageway 292 becomes greater from above to below in the vertical direction. The secondary oil return passageway 292 has, in its lower end in the vertical direction, a flow path resistance portion 292*c* at which the flow path resistance becomes the greatest.

(2) Temperature Sensor

Figure 14:
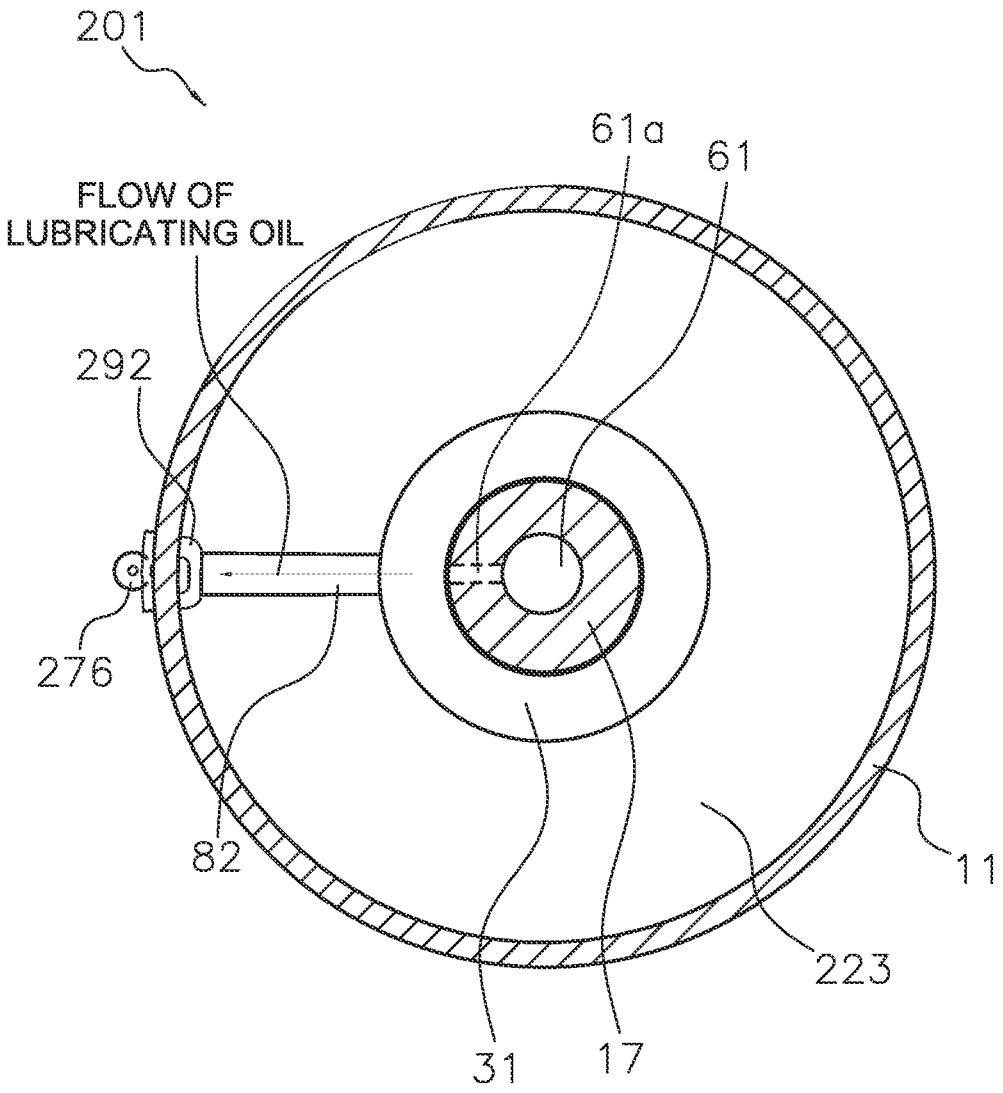
FIG. 14 is part of a transverse sectional view of the main frame pertaining to the third embodiment of the present invention in line segment XIV-XIV in FIG. 13.

In the present embodiment, a temperature sensor 276 is fixed to the casing outer peripheral surface, FIG. 13 shows the positional relationship between the main frame 223 and the temperature sensor 276 in the vertical direction, and FIG. 14 shows the positional relationship between the main frame 223 and the temperature sensor 276 in the horizontal direction. The temperature sensor 276 is fixed to the section of the casing outer peripheral surface corresponding to the back side of the section of the casing inner peripheral surface contiguous to the flow path resistance portion 292*c*.

<Actions>

In the present embodiment, the lubricating oil that has passed through the oil return passageway 82 flows into the secondary oil return passageway 292, The lubricating oil flowing through the secondary oil return passageway 292 is lubricating oil that has reached a high temperature because of the operating action of the scroll compressor 201. The section of the casing outer peripheral surface corresponding to the back side of the section of the casing inner peripheral surface contiguous to the flow path resistance portion 292*c* and the side surface of the main frame 223 in the neighborhood of the flow path resistance portion 292*c* (hereinafter, in the present embodiment, this section will be called "the temperature measuring region") is a region to which the heat of the lubricating oil flowing through the oil flow path 292 is more efficiently transmitted compared to other sections of the casing outer peripheral surface.

In the present embodiment, the temperature sensor 276 is fixed to the section of the casing outer peripheral surface corresponding to the back side of the section of the casing inner peripheral surface contiguous to the flow path resistance portion 292*c* and which is part of the temperature measuring region. Consequently, the heat of the lubricating oil flowing through the flow path resistance portion 292*c* is transmitted to the temperature sensor 276 via just the barrel casing portion 11, so the temperature sensor 276 can appropriately measure the temperature of the lubricating oil flowing through the oil flow path 292.

<Characteristics>

In the scroll compressor 201 pertaining to the present embodiment, the high-temperature lubricating oil that has lubricated the sliding portions inside the casing 10 flows through the secondary oil return passageway 292. The heat of the lubricating oil flowing through the secondary oil return passageway 292 is efficiently transmitted to the temperature measuring region of the casing outer peripheral surface. The temperature sensor 276 can appropriately measure the temperature of the lubricating oil flowing inside the scroll compressor 201 by measuring the temperature of the temperature measuring region.

<Modifications>

(1) Modification 3A

Figure 16:
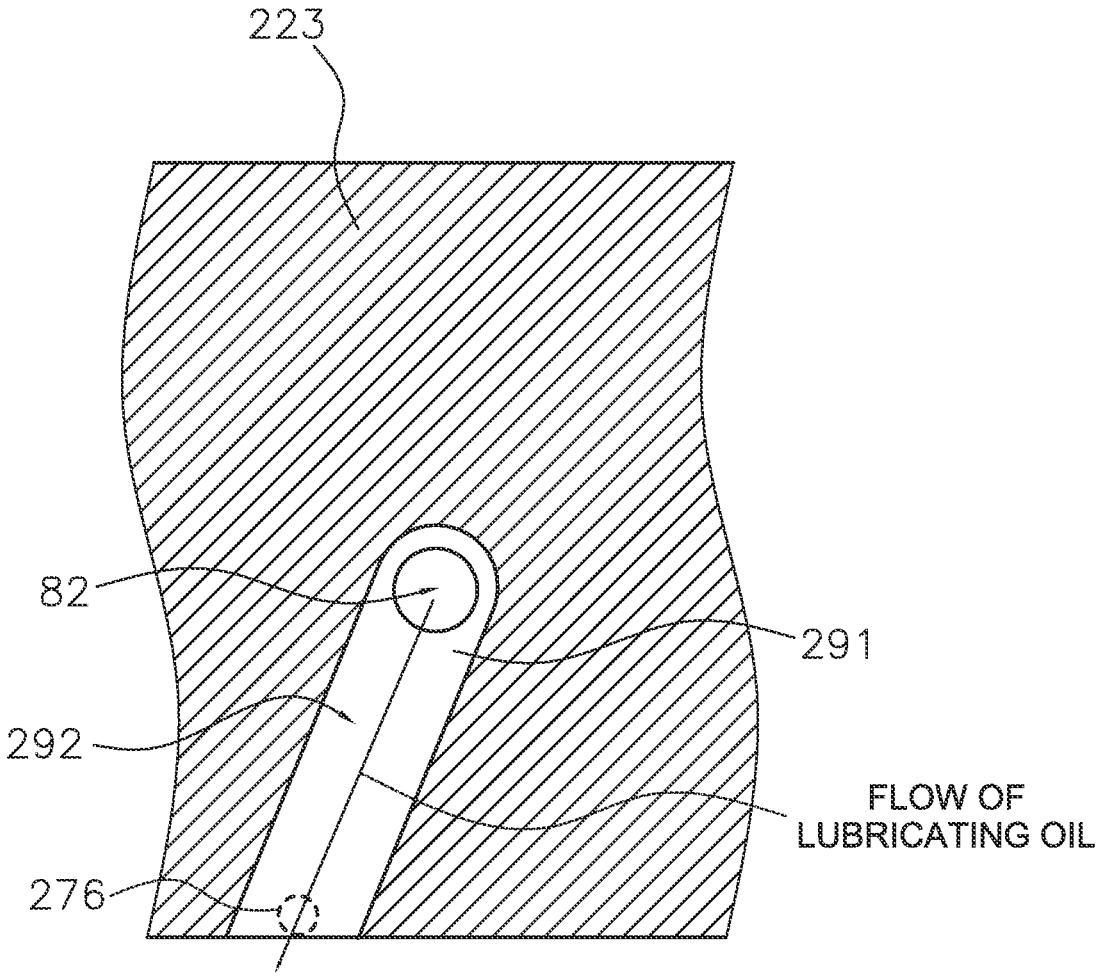
FIG. 16 is a side view of the main frame pertaining to modification 3A of the third embodiment of the present invention.

In the scroll compressor 201 pertaining to the present embodiment, the secondary oil return passageway 292 has a shape where, in a case where the secondary oil return passageway 292 is seen along the radial direction of the casing 10 as shown in FIG. 15, the flow path width becomes smaller from above to below in the vertical direction, but as shown in FIG. 16, the secondary oil return passageway 292 may also have a shape in which the flow path width is constant and which is inclined with respect to the vertical direction.

The amount of time in which the lubricating oil passes through the secondary oil return passageway 292 pertaining to the present modification is longer compared to that of a secondary oil return passageway extending in the vertical direction. That is, the secondary oil return passageway 292 of the present modification can increase the quantity of heat transmitted from the lubricating oil to the casing outer peripheral surface. Consequently, the temperature sensor 276 can appropriately measure the temperature of the lubricating oil flowing inside the scroll compressor 201.

(2) Modification 3B

Figure 17A:
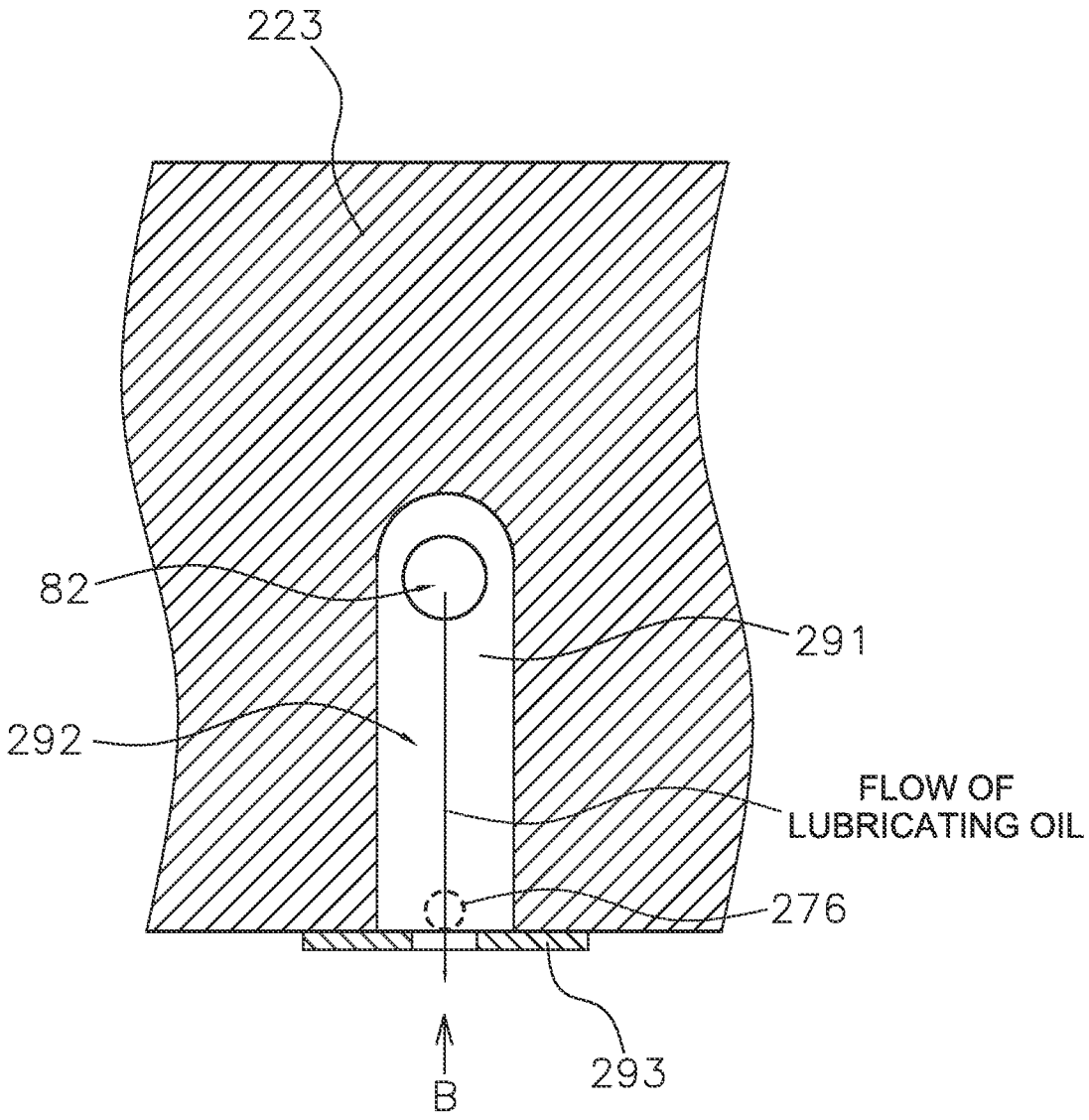
FIG. 17A is a side view of the main frame pertaining to modification 3B of the third embodiment of the present invention.
Figure 17B:
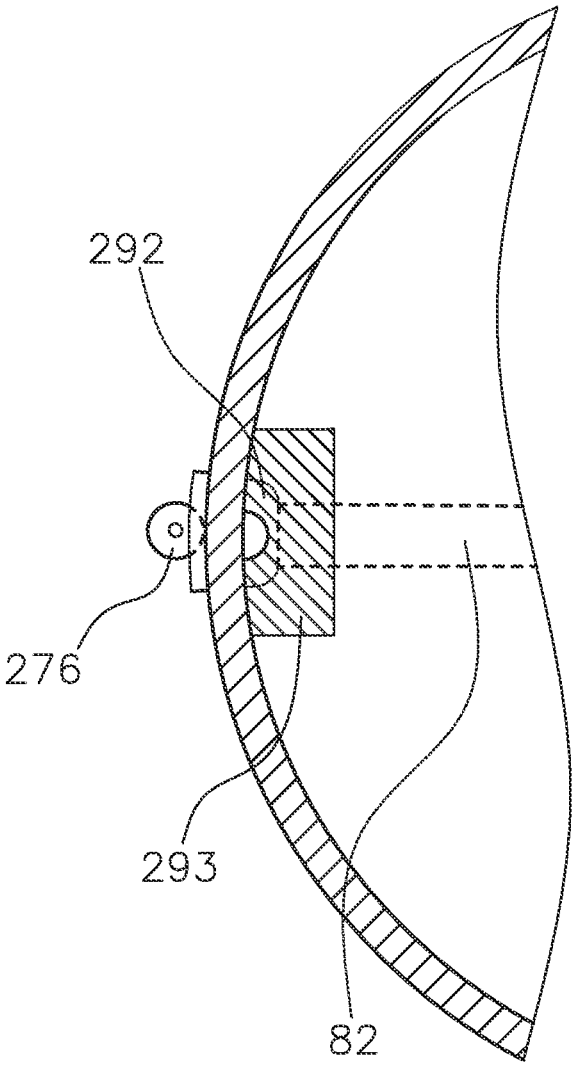
FIG. 17B is a bottom view of the main frame pertaining to modification 3B of the third embodiment of the present invention as seen from arrow B in FIG. 17A.

In the scroll compressor 201 pertaining to the present embodiment, the secondary oil return passageway 292 has a shape where, in a case where the secondary oil return passageway 292 is seen along the radial direction of the casing 10 as shown in FIG. 15, the flow path width becomes smaller from above to below in the vertical direction, but as shown in FIG. 17A and FIG. 17B, the secondary oil return passageway 292 may also be configured in such a way that the flow path width is constant and part of the open portion on the lower side of the secondary oil return passageway 292 is closed off by a cover 293 attached to the main frame 223.

In the present modification, the flow path resistance of the secondary oil return passageway 292 is increased by the cover 293. That is, the cover 293 of the present modification can increase the quantity of heat transmitted from the lubricating oil to the casing outer peripheral surface. Consequently, the temperature sensor 276 can appropriately measure the temperature of the lubricating oil flowing inside the scroll compressor 201.

(3) Modification 3C

The scroll compressor 201 pertaining to the present embodiment may also have a combination of two or more elements selected from the group comprising the secondary oil return passageway 292 pertaining to the present embodiment, the secondary oil return passageway pertaining to modification 3A, and the cover 293 pertaining to modification 3B.

(4) Modification 3D

The scroll compressor 201 pertaining to the present embodiment may further have the oil return plate 91 that the scroll compressor 1 pertaining to the first embodiment has and the oil return plate 191 that the scroll compressor 101 pertaining to the second embodiment has, Modification 1A and modification 1B applied to the first embodiment may also be applied to the present embodiment.

Further, the temperature sensor 276 that the scroll compressor 201 pertaining to the present embodiment has may also measure the temperature of the temperature measuring region outside the section of the casing outer peripheral surface corresponding to the back side of the section of the casing inner peripheral surface contiguous to the flow path resistance portion 292*c*.

Fourth Embodiment

Figure 18:
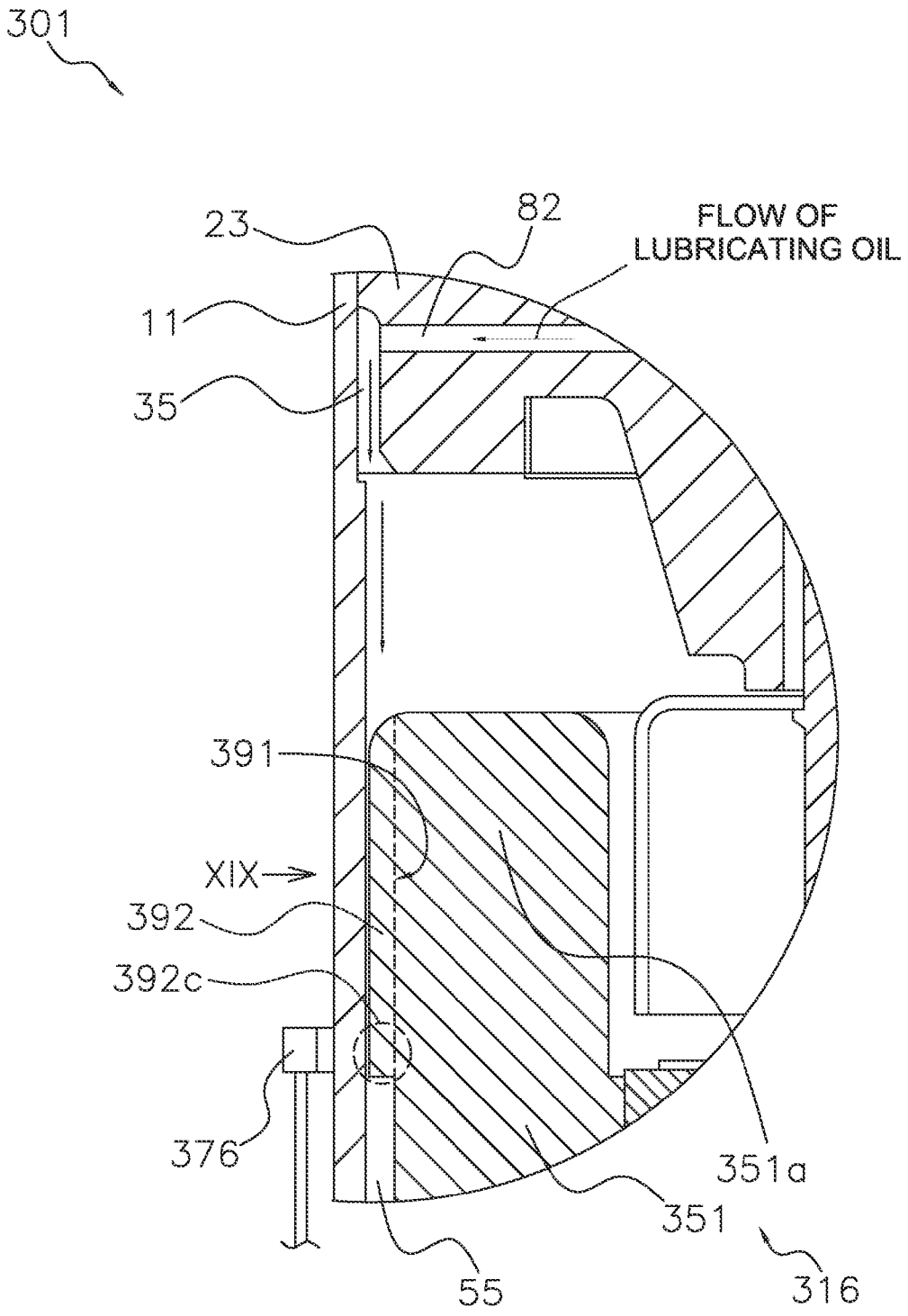
FIG. 18 is a longitudinal sectional view of a coil end of a motor pertaining to a fourth embodiment of the present invention.

A compressor pertaining to a fourth embodiment of the present invention will be described with reference to FIG. 18 and FIG. 19. A scroll compressor 301 pertaining to the present embodiment has configurations, actions, and characteristics shared in common with those of the scroll compressor 1 pertaining to the first embodiment. The differences between the scroll compressor 301 pertaining to the present embodiment and the scroll compressor 1 pertaining to the first embodiment will be mainly described.

<Configurations>

(1) Motor

The scroll compressor 301 pertaining to the present embodiment does not have the oil return plate 91 that the scroll compressor 1 pertaining to the first embodiment has. In the scroll compressor 301 pertaining to the present embodiment, as shown in FIG. 18, a motor 316 has a flow path forming surface 391. The flow path forming surface 391 is a recessed surface that is part of a side surface of a coil end 351*a* on the upper side of a stator 351 and forms an oil groove 392. The oil groove 392 is formed by shaping part of the coil of the coil end 351*a* into the shape of a groove.

The oil groove 392 is a groove that is positioned under the secondary oil return passageway 35 and through which the lubricating oil that has fallen downward from the secondary oil return passageway 35 flows. The oil groove 392 has a shape where, in a case where the oil groove 392 is seen along the radial direction of the casing 10 as shown in FIG. 19, the flow path width becomes smaller from above to below in the vertical direction. Further, the oil groove 392 has a shape where, as shown in FIG. 18, it becomes closer to the casing inner peripheral surface from above to below in the vertical direction. That is, the flow path resistance of the oil groove 392 becomes greater from above to below in the vertical direction. The oil groove 392 has, in its lower end in the vertical direction, a flow path resistance portion 392*c* at which the flow path resistance becomes the greatest.

(2) Temperature Sensor

In the present embodiment, a temperature sensor 376 is fixed to the casing outer peripheral surface. FIG. 18 and FIG. 19 show the positional relationship between the motor 316 and the temperature sensor 376. The temperature sensor 376 is fixed to the section of the casing outer peripheral surface corresponding to the back side of the section of the casing inner peripheral surface contiguous to the flow path resistance portion 392*c*.

<Actions>

In the present embodiment, the lubricating oil that has passed through the secondary oil return passageway 35 flows into the oil groove 392, The lubricating oil flowing through the oil groove 392 is lubricating oil that has reached a high temperature because of the operating action of the scroll compressor 301. The section of the casing outer peripheral surface corresponding to the back side of the section of the casing inner peripheral surface contiguous to the flow path resistance portion 392*c* and the side surface of the motor 316 in the neighborhood of the flow path resistance portion 392*c* (hereinafter, in the present embodiment, this section will be called "the temperature measuring region") is a region to which the heat of the lubricating oil flowing through the oil groove 392 is more efficiently transmitted compared to other sections of the casing outer peripheral surface.

In the present embodiment, the temperature sensor 376 is fixed to the section of the casing outer peripheral surface corresponding to the back side of the section of the casing inner peripheral surface contiguous to the flow path resistance portion 392*c* and which is part of the temperature measuring region. Consequently, the heat of the lubricating oil flowing through the flow path resistance portion 392*c* is transmitted to the temperature sensor 376 via just the barrel casing portion 11, so the temperature sensor 376 can appropriately measure the temperature of the lubricating oil flowing through the oil groove 392.

<Characteristics>

In the scroll compressor 301 pertaining to the present embodiment, the high-temperature lubricating oil that has lubricated the sliding portions inside the casing 10 flows through the oil groove 392. The heat of the lubricating oil flowing through the oil groove 392 is efficiently transmitted to the temperature measuring region of the casing outer peripheral surface. The temperature sensor 376 can appropriately measure the temperature of the lubricating oil flowing inside the scroll compressor 301 by measuring the temperature of the temperature measuring region.

<Modifications>

(1) Modification 4A

Figure 19:
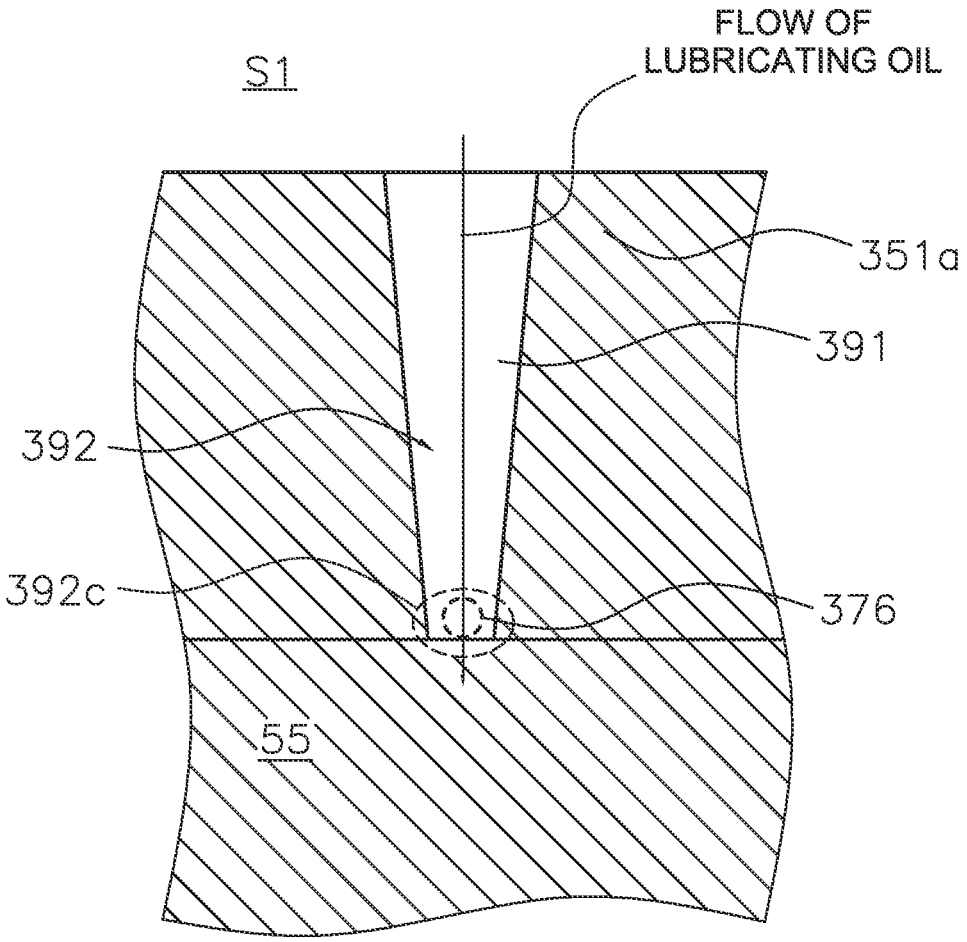
FIG. 19 is a side view of the coil end of the motor pertaining to the fourth embodiment of the present invention as seen from arrow XIX in FIG. 18.
Figure 20:
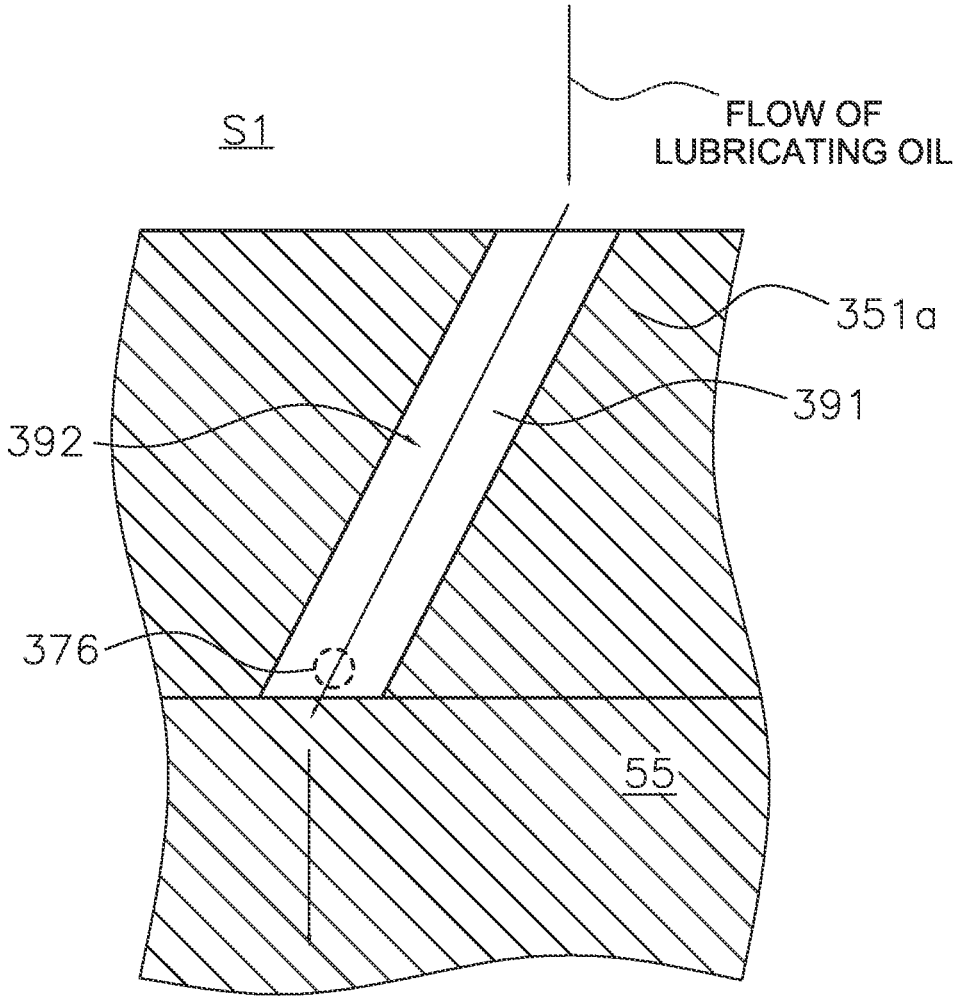
FIG. 20 is a side view of the coil end of the motor pertaining to modification 4A of the fourth embodiment of the present invention.

In the scroll compressor 301 pertaining to the present embodiment, the oil groove 392 has a shape where, in a case where the oil groove 392 is seen along the radial direction of the casing 10 as shown in FIG. 19, the flow path width becomes smaller from above to below in the vertical direction, but as shown in FIG. 20, the oil groove 392 may also have a shape in which the flow path width is constant and which is inclined with respect to the vertical direction.

The amount of time in which the lubricating oil passes through the oil groove 392 pertaining to the present modification is longer compared to that of an oil groove extending in the vertical direction. That is, the oil groove 392 of the present modification can increase the quantity of heat transmitted from the lubricating oil to the casing outer peripheral surface. Consequently, the temperature sensor 376 can appropriately measure the temperature of the lubricating oil flowing inside the scroll compressor 301.

(2) Modification 4B

Figure 21:
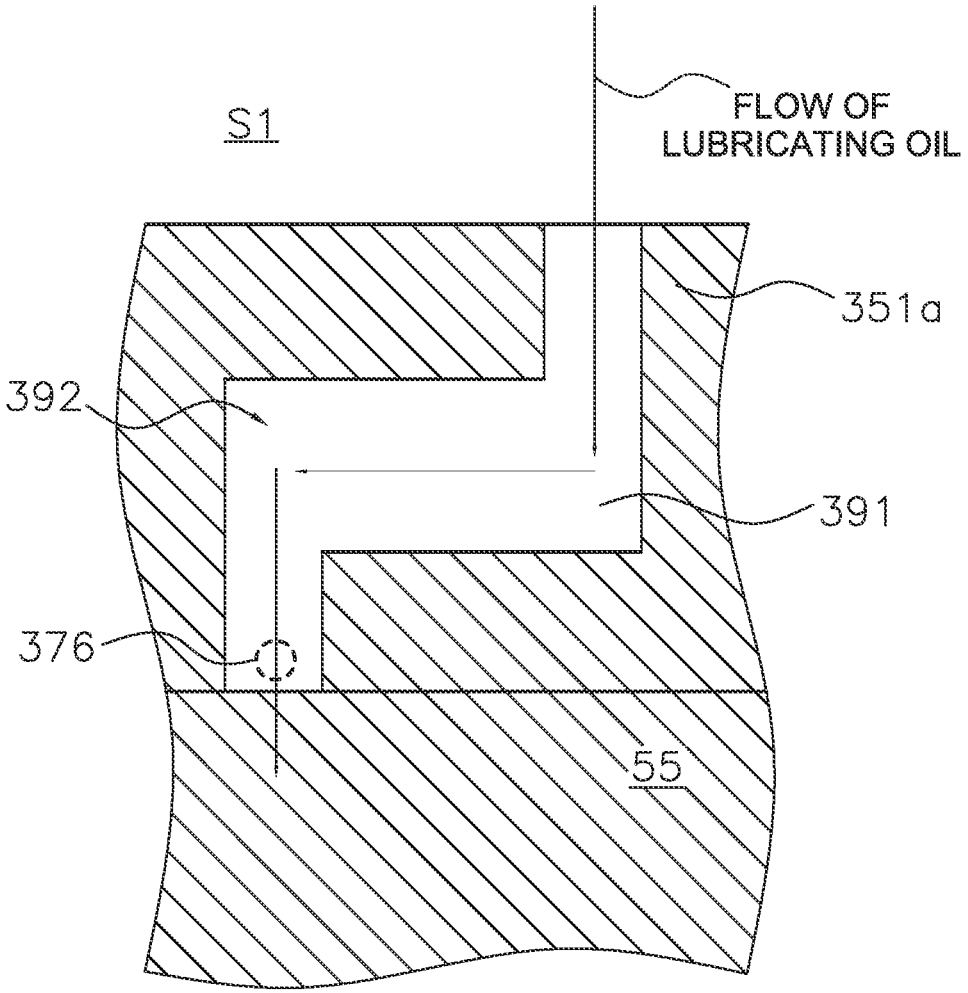
FIG. 21 is a side view of the coil end of the motor pertaining to modification 4B of the fourth embodiment of the present invention.

In the scroll compressor 301 pertaining to the present embodiment, the oil groove 392 has a shape where, in a case where the oil groove 392 is seen along the radial direction of the casing 10 as shown in FIG. 19, the flow path width becomes smaller from above to below in the vertical direction, but as shown in FIG. 21, the oil groove 392 may also have a flow path in the horizontal direction.

The amount of time in which the lubricating oil passes through the oil groove 392 pertaining to the present modification is longer compared to that of an oil groove extending in the vertical direction. That is, the oil groove 392 of the present modification can increase the quantity of heat transmitted from the lubricating oil to the casing outer peripheral surface. Consequently, the temperature sensor 376 can appropriately measure the temperature of the lubricating oil flowing inside the scroll compressor 301.

(3) Modification 4C

In the scroll compressor 301 pertaining to the present embodiment, the motor 316 is a distributed winding motor but it may also be a concentrated winding motor. Further, in the present modification, in a case where the motor 316 is a concentrated winding motor having an insulator, the flow path forming surface 391 may be part of a side surface of the insulator. In this case, the oil groove 392 is formed by shaping part of the side surface of the insulator into the shape of a groove. In the present modification also, the temperature of the lubricating oil flowing inside the scroll compressor 301 can be appropriately measured.

(4) Modification 4D

The scroll compressor 301 pertaining to the present embodiment may also have a combination of two or more elements selected from the group comprising the oil grooves 392 pertaining to the present embodiment, the oil groove pertaining to modification 4A, and the oil groove pertaining to modification 4B.

(5) Modification 4E

The scroll compressor 301 pertaining to the present embodiment may further have the oil return plate 191 that the scroll compressor 101 pertaining to the second embodiment has and the main frame 223 that the scroll compressor 201 pertaining to the third embodiment has. Modification 1A and modification 1B applied to the first embodiment may also be applied to the present embodiment.

Further, the temperature sensor 376 that the scroll compressor 301 pertaining to the present embodiment has may also measure the temperature of the temperature measuring region outside the section of the casing outer peripheral surface corresponding to the back side of the section of the casing inner peripheral surface contiguous to the flow path resistance portion 392*c*.

INDUSTRIAL APPLICABILITY

The compressor pertaining to the present invention has a mechanism that appropriately measures the temperature inside the compressor, on by performing a protective operation in accordance with the temperature inside the compressor, the reliability of the compressor can be improved. Consequently, by using the compressor pertaining to the present invention in a refrigeration cycle, the reliability of a refrigerating apparatus such as an air conditioning apparatus can be improved.

What is claimed is:

1. A compressor comprising:

a casing configured to store lubricating oil in an oil pool disposed in a bottom portion thereof;

a compression mechanism disposed inside the casing to compress refrigerant;

a drive shaft disposed inside the casing to drive the compression mechanism;

a main frame air-tightly joined to an inner peripheral surface of the casing along an entire periphery of the inner peripheral surface, the main frame supporting the drive shaft such that the drive shaft is freely rotatable, and the compression mechanism being disposed on the main frame;

a motor disposed under the main frame to drive the drive shaft;

a flow path forming member disposed inside the casing to form an oil flow path at a space adjacent the inner peripheral surface of the casing, the oil flow path being arranged to carry a flow of lubricating oil, which lubricates sliding portions including the compression mechanism and the drive shaft, the oil flow path being disposed above the oil pool, and in any one of a space between the main frame and the motor, a space between the motor and the casing, and a space between the main frame and the casing; and a temperature measuring mechanism disposed outside the casing to measure a temperature of a section of an outer peripheral surface of the casing so as to measure a temperature of lubricant oil passing through the oil flow path before entering the oil pool, the motor including a stator fixed to the inner peripheral surface of the casing, the oil flow path having a space contiguous to the inner peripheral surface of the casing, the flow path forming member having a section contiguous to the inner peripheral surface of the casing, the temperature measuring mechanism measuring a temperature of a temperature measuring region that is a section of the outer peripheral surface of the casing corresponding to a back side of a section of the inner peripheral surface of the casing contiguous to the oil flow path and the flow path forming member, and at least a portion of the temperature measuring mechanism being disposed above or below a midpoint of the stator of the motor in an axial direction of the drive shaft.

2. The compressor according to claim 1, wherein the oil flow path has a narrow portion having a substantially flat-shaped flow path cross section, the narrow portion has a shape in which a long axis direction of the flow path cross section is along a circumferential direction of the casing and has a flow path cross-sectional area that is smaller than a flow path cross-sectional area of the oil flow path excluding the narrow portion, and the temperature measuring mechanism measures the temperature of the temperature measuring region adjacent the narrow portion.

3. The compressor according to claim 1, wherein the flow path forming member is an oil return plate disposed under the main frame and above the motor, and the oil flow path is a space between the inner peripheral surface of the casing and the oil return plate.

4. The compressor according to claim 1, wherein the flow path forming member is an oil return plate disposed under the motor, and the oil flow path is a space between the inner peripheral surface of the casing and the oil return plate.

5. The compressor according to claim 1, wherein the main frame has an oil return passageway through which lubricating oil that has lubricated the sliding portions flows, the flow path forming member has a flow path forming surface that is part of a side surface of the main frame, and which is spaced apart from and opposes the inner peripheral surface of the casing, and to which the oil return passageway opens, and the oil flow path is a space between the inner peripheral surface of the casing and the flow path forming surface.

6. The compressor according claim 2, wherein the flow path forming member is an oil return plate disposed under the main frame and above the motor, and the oil flow path is a space between the inner peripheral surface of the casing and the oil return plate.

7. The compressor according to claim 2, wherein the flow path forming member is an oil return plate disposed under the motor, and the oil flow path is a space between the inner peripheral surface of the casing and the oil return plate.

8. The compressor according to claim 2, wherein the main frame has an oil return passageway through which lubricating oil that has lubricated the sliding portions flows, the flow path forming member has a flow path forming surface that is part of a side surface of the main frame, and which is spaced apart from and opposes the inner peripheral surface of the casing, and to which the oil return passageway opens, and the oil flow path is a space between the inner peripheral surface of the casing and the flow path forming surface.

* * * * *